United States Patent [19]

Oishi et al.

[11] 3,930,866

[45] Jan. 6, 1976

[54] SILVER HALIDE COLOR PHOTOGRAPHIC MATERIALS CONTAINING 3-ANILINO-5-PYRAZOLONE COUPLERS

[75] Inventors: Yasushi Oishi; Minoru Yamada; Hiroyuki Amano; Tokio Nishimura, all of Minami-ashigara, Japan

[73] Assignee: Fuji Photo Film Co., Ltd., Minami-ashigara, Japan

[22] Filed: Apr. 23, 1974

[21] Appl. No.: 463,236

[30] Foreign Application Priority Data

Apr. 25, 1973 Japan ..... 48-47465

[52] U.S. Cl. ..... 96/100; 96/56; 96/56.5; 96/95

[51] Int. Cl.[2] ..... G03C 1/40

[58] Field of Search ..... 96/56, 95, 100

[56] References Cited

UNITED STATES PATENTS

| | | | |
|---|---|---|---|
| 3,127,269 | 3/1964 | Greenhalgh et al. | 96/100 |
| 3,698,909 | 10/1972 | Lestina et al. | 96/100 |
| 3,761,274 | 9/1973 | Inoue et al. | 96/100 |
| 3,764,337 | 10/1973 | Arai et al. | 96/56 |

*Primary Examiner*—J. Travis Brown

*Attorney, Agent, or Firm*—Sughrue, Rothwell, Mion Zinn & Macpeak

[57] ABSTRACT

A color photographic material having at least one silver halide emulsion layer containing a 3-anilino-5-pyrazolone type magenta dye forming coupler and a phenolic compound for improving the light fastness of the magenta dye formed by the coupling reaction of the magenta dye forming coupler with the oxidation product of a color developing agent in combination with a nucleus-substituted hydroquinone, in which the reduction of the coupling reactivity of the magenta dye forming coupler during the storage of the color photographic material caused by the presence of the phenolic compound is prevented efficiently.

22 Claims, No Drawings

SILVER HALIDE COLOR PHOTOGRAPHIC MATERIALS CONTAINING 3-ANILINO-5-PYRAZOLONE COUPLERS

BACKGROUND OF THE INVENTION

1. Field of the Invention

This invention relates to a method of improving the storage properties of a color photographic material and also to a color photographic material having improved storage properties, in particular to a silver halide color photographic material having a silver halide emulsion layer containing a magenta dye forming coupler or a magenta forming coupler capable of forming a magenta dye image having excellent hue and fastness.

2. Description of the Prior Art

In the field of silver halide color photography, a magenta dye forming coupler used for forming magenta dye images must meet various conditions. That is to say, it is required that the magenta dye forming coupler shows a high coupling activity in the coupling reaction with the oxidation product of a color developing agent, the coupler can form, by color development, a magenta dye image having suitable spectral characteristics for the color reproduction by the subtractive color process (since a magenta dye image absorbs the light in the wave length region to which the human eye is most sensitive, the spectral characteristics of the magenta dye image are a very important factor dominating the color reproducibility in color photography), and the magenta dye forming coupler can form a magenta dye image having high fastness to light, heat, moisture, etc.

Also, when the magenta dye forming coupler is of the type which is incorporated in a silver halide emulsion layer of a color photographic material, it is further required that the properties, in particular, the coupling activity of the coupler is not reduced during the storage of the color photographic material, the coupler can be easily introduced in the silver halide emulsion, the coupler incorporated in the silver halide emulsion layer is stable without concerns on crystallization, etc., during the storage of the photographic material, and further the coupler does not provide, after color development, the causes of color staining by the actions of light, heat, moisture, etc., be present.

As magenta dye forming couplers, various compounds such as pyrazolone couplers, cyanoacetyl couplers, indazolone couplers, etc., are known. In particular, as the pyrazolone type magenta forming couplers, there are proposed, for instance, the 3-anilino-5-pyrazolones (see, e.g., U.S. Pat. No. 2,311,081, etc.), the 3-alkoxy-5-pyrazolone couplers (see, e.g., U.S. Pat. No. 2,439,098, etc.), the 3-acylamino-5-pyrazolones (see, e.g., U.S. Pat. Nos. 2,369,489; 2,600,788, etc.), and the 3-ureido-5-pyrazolones (see e.g., U.S. Pat. No. 3,558,319, etc.). Of these pyrazolone couplers, the 3-anilino-5-pyrazolone couplers are excellent in providing dye images which have high fastness to heat and moisture. Non-diffusible magenta couplers which belong to the 3-anilino-5-pyrazolone couplers and have a ballast group in the molecule so that they can be introduced in silver halide emulsion layers of photographic materials are described in U.S. Pat. Nos. 3,419,391; 3,519,429; 3,127,269; 3,684,514; 3,761,274 and 3,658,544; and U.S. Pat. application Ser. Nos. 415,864, filed Nov. 13, 1973; 415,853, filed Nov. 14, 1973 and 445,032 filed Feb. 22, 1974.

Of these 3-anilino-5-pyrazolone couplers, a coupler having a halogen atom, an alkyl group, an aryl group, an alkoxy group, an aryloxy group, a N-substituted amino group, an amido group, a hydroxyl group, a cyano group, or a nitro group at least one of the 2-position and the 6-position of the anilino group thereof and also a hydrophobic ballast group at the aromatic nucleus of the anilino group is particularly preferable in that the coupler has less undesired absorptions in the blue region and the red region, the coupler forms a magenta dye image having excellent spectral characteristics, and also the coupler has a high coupling activity.

The 3-substituted anilino-5-pyrazolone couplers as indicated above meet the various requirements as desirable magenta dye forming couplers but have a serious disadvantage in that the magenta dye images formed from such magenta couplers are insufficiently fast to right. Thus, various proposals have been made for minimizing this disadvantage to prevent the fading of the magenta dye images by light. According to a very effective method of these proposals, a phenolic compound is used together with the aforesaid magenta dye forming coupler. Preferred examples of such a phenolic compound are the alkoxyphenols, aryloxyphenols, hydroxycoumarans, hydroxychromans, and dihydroxyspirochromans as described in U.S. Pat. Nos. 3,432,300; 3,573,050; 3,574,627 and 3,764,337 and German Offenlegungsschriften 2,146,668.

However, when a photographic material containing the phenolic compound and the 3-substituted anilino-5-pyrazolone type magenta coupler as described above in a silver halide emulsion layer thereof is stored at an ordinary room temperature, the coupling density of the magenta coupler begins to reduce after about one month and the coupling density becomes less than a half of the value immediately after the production of the photographic material after about six months of storage. This phenomenon greatly reduces the commercial value of color photographic materials. Therefore, a means of removing those defficiencies has been desired.

SUMMARY OF THE INVENTION

An object of this invention is, therefore, to provide a method of preventing a reduction in the coupling density of the 3-anilino-5-pyrazolone type magenta coupler in a silver halide emulsion layer of a color photographic material caused by the presence of a compound used in combination with the magenta coupler for preventing the fading of magenta dye image during the storage of the color photographic material.

Another object of this invention is to provide a color photographic material which can be stored without degrading the photographic properties such as the sensitivity, coupling density, etc., and can form magenta dye images having high fastness to light, heat, and moisture and having good spectral characteristics.

The inventors have discovered that the reduction in the coupling density of the 3-anilino-5-pyrazolone type magenta forming coupler incorporated in a silver halide emulsion layer of a color photographic material caused by the phenolic compound used in combination with the magenta forming coupler for preventing the fading of the magenta dye image formed can be prevented by using a nucleus-substituted hydroquinone.

Thus, it has been descovered that the above-described objects of this invention can be attained by using a nucleus-substituted hydroquinone together with the 3-anilino-5-pyrazolone type magenta dye forming coupler and the phenolic compound having an ether bond at the 4-position and having the ability to prevent the light fading of the magenta dye image formed from the magenta coupler.

Therefore, according to the present invention, a method is provided for preventing the coupling reactivity of a 3-anilino-5-pyrazolone type magenta dye forming coupler from decreasing during the storage of the color photographic material having a silver halide emulsion layer containing the magenta dye forming coupler in combination with a phenolic compound having an ether bond at the 4-position and having a property of improving the fastness to light of the magenta dye image formed by the coupling reaction of the coupler and the oxidation product of a color developing agent, which comprises incorporating a nucleus-substituted hydroquinone in the silver halide emulsion layer containing the magenta dye forming coupler and the phenolic compound.

Also, according to the another embodiment of the present invention, a color photographic material is provided comprising a support having thereon a silver halide photographic emulsion layer containing A. a 3-anilino-5-pyrazolone type magenta dye forming coupler having a halogen atom, an alkyl group, an aryl group, an alkoxy group, an aryloxy group, an N-substituted amino group, an amido group, a hydroxyl group, a cyano group, or a nitro group at at least one of the 2-position and the 6-position of the anilino group thereof and also having a hydrophobic ballast group at the aromatic nucleus of the anilino group;

B. a phenolic compound having an ether bond at the 4-position thereof and having the property of improving the fastness to light of the magenta dye image formed by the coupling reaction of the magenta dye forming coupler and the oxidation product of a color developing agent; and C. a nucleus-substituted hydroquinone.

DETAILED DESCRIPTION OF THE INVENTION

The 3-anilino-5-pyrazolone type magenta dye forming couplers which can be used in this invention include the compounds represented by the following general formula (I)

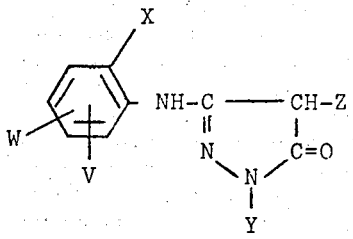

(I)

wherein X represents an alkyl group (such as a methyl group, a tert-butyl group, an octyl group, a dodecyl group, etc.); an aryl group (such as a phenyl group, a tolyl group, etc.); an alkoxy group (such as a methoxy group, an octyloxy group, etc.); an aryloxy group (such as a phenoxy group, a p-tert-butylphenoxy group, a naphthoxy group, etc.); an N-substituted amino group (such as a methylamino group, a diethylamino group, an anilino group, etc.); an amido group (such as an acetamido group, a butyramido group, a methylsulfonamido group, a diacylamido group, etc.); a hologen atom (such as a fluorine atom, a chlorine atom, a bromine atom, etc.); a hydroxyl group; a cyano group; or a nitro group; Y represents an unsubstituted aryl group or substituted aryl group containing halogen, cyano, nitro, alkyl, alkoxy, aryl, aryloxy, acylamido, carbamoyl, sulfonamido, sulfamoyl, amino, acyl, acyloxy, alkylthio, alkoxycarbonyl, etc. substituents (such as a phenyl group, a 2-chlorophenyl group, a 4-chlorophenyl group, a 2,5 -dichlorophenyl group, a 2,6-dichlorophenyl group, a 2,4,6-trichlorophenyl group, a 2-bromophenyl group, a 3,5-dibromophenyl group, a 2-cyanophenyl group, a 4-cyanophenyl group, a 3-nitrophenyl group, a 4-nitrophenyl group, a 4-methylphenyl group, a 2,6-dimethylphenyl group, a 2,6-diethylphenyl group, a 4-butylphenyl group, a 2-trifluoromethylphenyl group, a 2-ethoxyphenyl group, a 4-phenylphenyl group, a 4-phenoxyphenyl group, a 2-methyl-5-nitrophenyl group, a 2-chloro5-cyanophenyl group, a 5-chloro-2-methylphenyl group a 2,6-dichloro-4-methylphenyl group, a 2,4-dichloro-6-methoxycarbonylphenyl group, a 2,4-dichloro-6-methylphenyl group, a 2-chloro-4,6-dimethylphenyl group, a 2,6-dichloro-4-methoxyphenyl group, a 2,6-dichloro-4-nitrophenyl group, a 2,4,6-trimethyl-3-nitrophenyl group, a 2,4,6-trimethyl-3-acetamidophenyl group, etc.); or an unsubstituted heterocyclic group or a substituted heterocyclic group containing halogen, cyano, nitro, alkyl, alkoxy, aryl, aryloxy, acylamido, carbamoyl, sulfonamido, sulfamoyl, amino, acyl, acyloxy, alkylthio, alkoxycarbonyl, etc. substituents (e.g., such a 5-membered or 6-membered heterocyclic ring as a 2-thiazolyl ring, a 2-benzothiazolyl ring, a 2-benzoxazolyl ring, a 2-oxazolyl ring, a 2-imidazolyl ring, a 2-benzimidazolyl ring, etc.); Z represents a hydrogen atom or a coupling releasable group; W represents a hydrophobic ballast group; and V represents a hydrogen atom or a group as defined by X or W.

The term "coupling releasable group" as used herein has the meaning commonly applied to color forming couplers and denotes a group which can be released from the active carbon atom at the coupling position of the coupler when the coupler couples with the oxidation product of an aromatic primary amine color developing agent. Also, the term "hydrophobic ballast group" as used herein has the meaning commonly applied to color forming couplers and denotes a hydrophobic group which is introduced into a coupler molecule for substantially fixing the coupler in a specific hydrophilic colloid layer and making the coupler diffusion resistant.

Suitable coupling releasable groups of the magenta dye forming coupler used in this invention are the groups bonded to the coupling position of the so-called colored couplers as described in U.S. Pat. Nos. 2,455,170; 2,688,539; 2,725,292; 2,983,608; and 3,005,712 and British Pat. Nos. 800,262 and 1,044,778; the groups bonded to the coupling position of the so-called development inhibitor releasing (DIR) type couplers as described in U.S. Pat. Nos. 3,148,062; 3,227,554; and 3,617,291; and the groups bonded to the coupling position of the couplers as described in U.S. Pat. Nos. 3,006,759; 3,214,437; 3,311,476 and 3,419,391.

Typical examples of such a group are a thiocyano group; an acyloxy group (such as an acetoxy group, a dodecanoyloxy group, an octadecanoyloxy group, a 3-pentadecylphenoxyacetoxy group, a benzoyloxy group, a β-naphthoyloxy group, a 3-[γ-(2,4-di-t-amylphenoxy)-butylamido]benzoyloxy group, etc.); an aryloxy group (such as a phenoxy group, a p-chlorophenoxy group, a p-nitrophenoxy group, a naphthoxy group, etc.); an aralkyloxy-carbonyloxy group (such as a benzyloxycarbonyloxy group, etc.); an alkyloxycarbonyloxy group (such as an ethyloxycarbonyloxy group, etc.); a halogen atom (such as a chlorine atom, a bromine atom, a fluorine atom, etc.); an arylazo group (such as a phenylazo group, a hydroxyphenylazo group, a chlorophenylazo group, a methylphenylazo group, a methoxyphenylazo group, a naphthylazo group, etc.); a 2-aryltriazolyl group (such as a 2-benzotriazolyl group, a 2-naphthoazolyl group, etc.); an alkylthio group (such as an alkylthio group having 4 to 10 carbon atoms, etc.); an arylthio group (such as a phenylthio group, a naphthylthio group, etc.); a heterothio group (such as a 2-benzthiazolylthio group, a 1-phenyl-5-tetrazolylthio group, a 2-benzoxazolylthio group, a 2-benzimidazolylthio group, a 5-phenyl-1,3,4-oxadiazolyl-2-thio group, etc.); a cycloalkylthio group (such as a cyclohexylthio group, etc.); a cycloalkoxy group (such as a cyclohexyloxy group, etc.) and an N-heterocyclic group (such as phthalimido, 1,2,3,4-tetra-hydroisoquinolyl, piperidinyl, imidazolyl, 5,5'-dimethyl-3-hydantoinyl, etc.).

It is appropriate that the hydrophobic ballast group of the magenta dye forming coupler which is used in this invention has generally more than about 8 carbon atoms. The effective upper limit of the number of carbon atoms of such a group is about 32 for ordinary purposes. Suitable examples of such hydrophobic ballast groups which can be employed in this invention are described in U.S. Pat. Nos. 2,600,788; 2,865,751; 3,337,344; and 3,418,129 and Japanese Pat. Nos. 27,563/1964 and 19,035/1970. Typical examples of hydrophobic groups include an alkyl group, an alkenyl group, an alkoxyalkyl group, an alkyl-substituted aryl group, an alkoxy-substituted aryl group, and a terphenyl group and these groups can be substituted with a halogen atom such as a fluorine atom and a chlorine atom or a group such as a nitro group, a cyano group, an alkoxycarbonyl group, an amido group, a carbamoyl group, a sulfonamido group, etc.

Specific examples of hydrophobic ballast groups are illustrated below:

1. Alkyl groups and alkenyl groups such as:

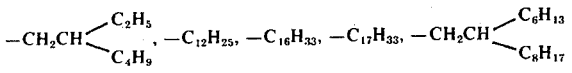

2. Alkoxyalkyl groups such as:

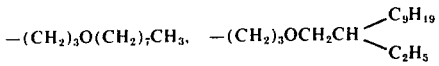

3. Alkyloxycarbonyl alkyl group $-CH_2CH_2COOC_{12}H_{25}$,

4. Residues having an alkyl or alkenyl long chain aliphatic group together with a water-solubilizing carboxyl or sulfo group:

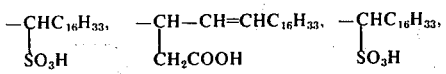

5. Acylamidoalkyl groups

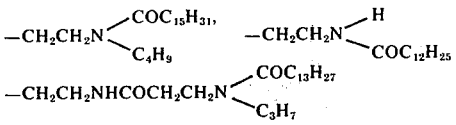

6. Alkoxyaryl groups, alkaryloxyaryl groups

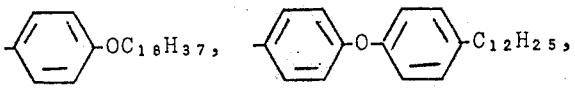

7. Alkylaryl groups

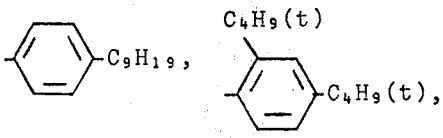

8. Alkylaryloxyalkyl groups

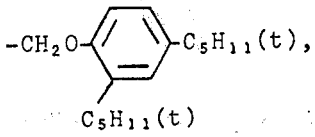

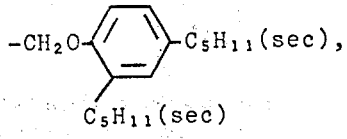

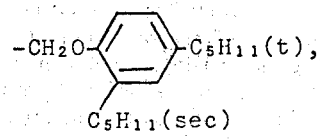

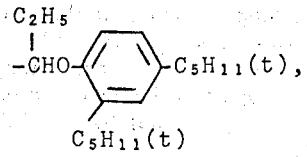

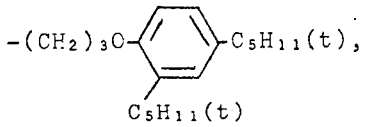

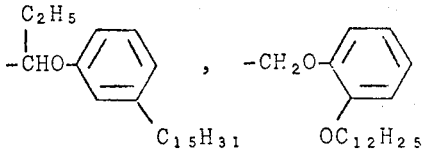

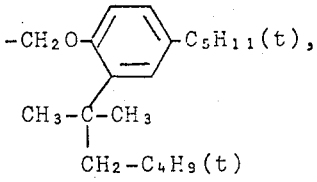

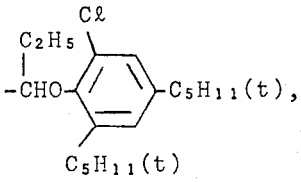

Furthermore, the hydrophobic ballast group as illustrated above can have as the bonding moiety to the aromatic nucleus of the anilino group the following moieties:

$-O-$, $-S-$, $-N<$, $-NHCO-$, $-NHSO_2-$,
$-NHCONH-$, $-CO-$, $-SO_2-$, $-CON<$,
$-SO_2N<$, $-COO-$, $-SO_2O-$, $-OCO-$, $-OSO_2-$, etc.

Also, such bispyrazolones in which two pyrazolone molecules are bonded to each other through group V, W, Y, or Z in general formula (I) described above are included in the 3-anilino-5-pyrazolone type magenta forming couplers which can be used in this invention.

The compounds of general formula (I) in which Y is the phenyl group having a halogen atom, an alkyl group, an alkoxy group, a carboxyl group, an alkoxycarbonyl group, a nitro group, an aryloxy group, an acylamino group, or a cyano group at at least one of the ortho-positions are excellent in that they have high stability to heat and light and form less color stains even if such couplers remain in the silver halide emulsion layers without being developed.

Particularly useful compounds among the magenta dye forming couplers which can be used in this invention are those represented by the following general formula (II)

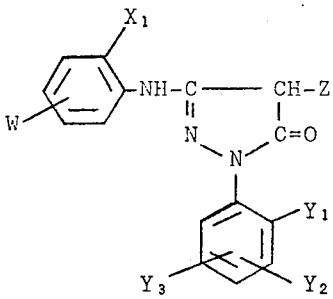

(II)

wherein W and Z have the same meaning as in the general formula (I); $X_1$ represents an alkyl group having 1 to 4 carbon atoms, an alkoxy group having 1 to 4 carbon atoms, a halogen atom, a hydroxyl group, a cyano group, or a nitro group; $Y_1$ represents a halogen atom, an alkyl group, an alkoxy group, a carboxyl group, an alkoxycarbonyl group, a nitro group, an aryloxy group, a cyano group, or an acylamino group; and $Y_2$ and $Y_3$, which may be the same or different, each represents a hydrogen atom or a group as defined for $Y_1$.

It is appropriate that the group represented by $Y_1$, $Y_2$, or $Y_3$ in the general formula (II) has less than about 6 carbon atoms.

In particular, the magenta forming couplers of general formula (II) in which the substituted phenyl group at the 1-position of the pyrazolone nucleus is 2,4-dichlorophenyl, 2,5-dichlorophenyl, 2,6-dichlorophenyl, 2,4,6-trichlorophenyl, 2,5-dibromophenyl 2,4-dibromophenyl, 2,6-dibromophenyl, 2,4,6-tribromophenyl, 2,4-dichloro-6-methylphenyl, 2,6-dichloro-4-methylphenyl, 2,4-dichloro-6-methoxyphenyl, 2,6-dichloro-4-methoxyphenyl, 2-chloro-4-nitrophenyl, or 2-chloro-5-nitrophenyl are particularly preferred since these couplers give a lesser degree of color stains by remaining uncoupled and the dye images formed from these couplers have particularly preferred spectral absorption characteristics (the absorption maximum is in a wave length region of 530 to 565 microns and the absorptions in a blue region and red region are less) as magenta dye images in color reproduction.

Specific examples of the magenta dye forming couplers which can be used in this invention are shown below:

Cp-1:

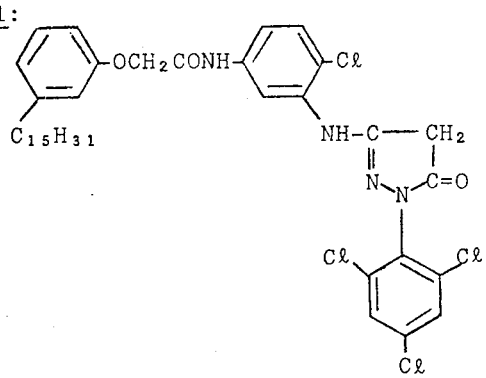

Cp-2:
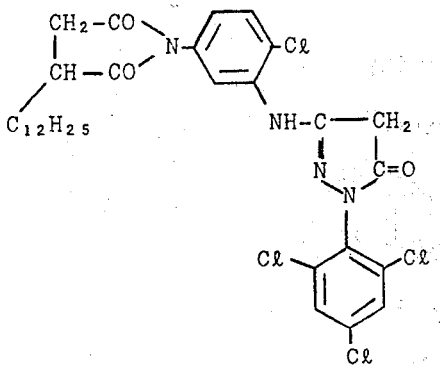
Cp-3:
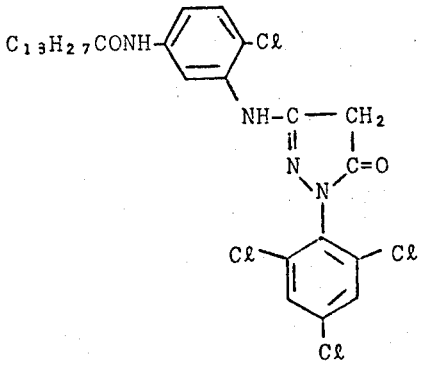
Cp-4:
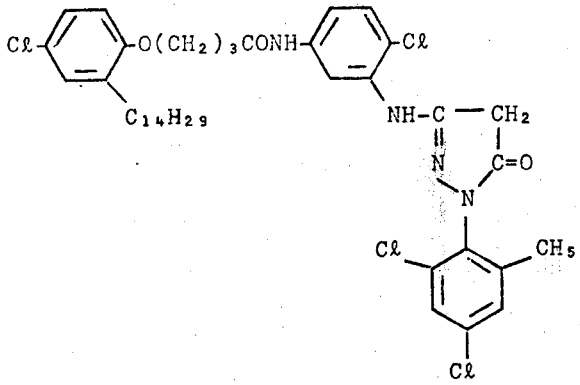
Cp-5:
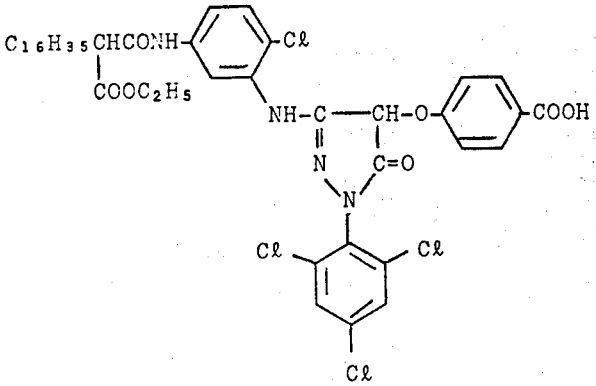
Cp-6:
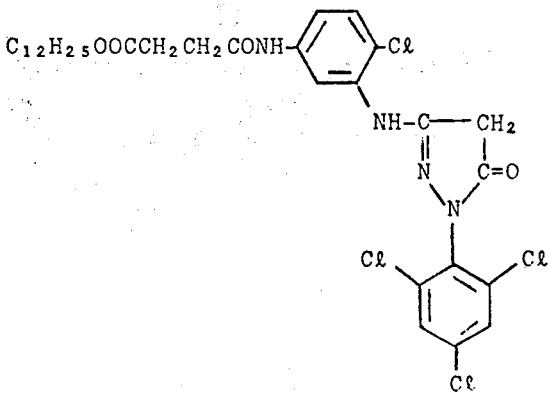
Cp-7:
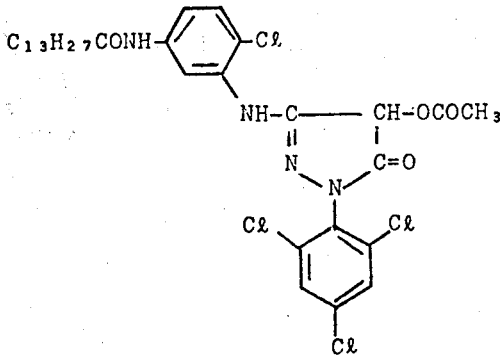
Cp-8:
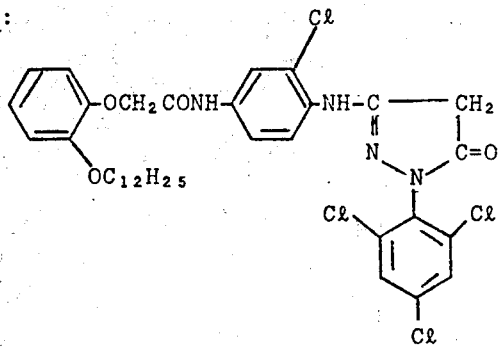
Cp-9:
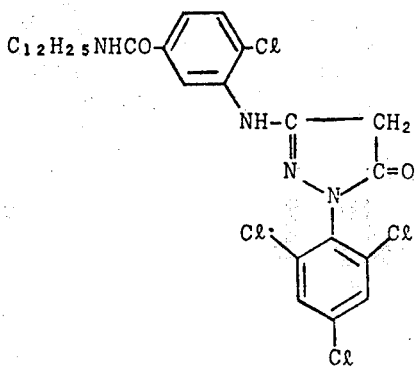

Cp-10:
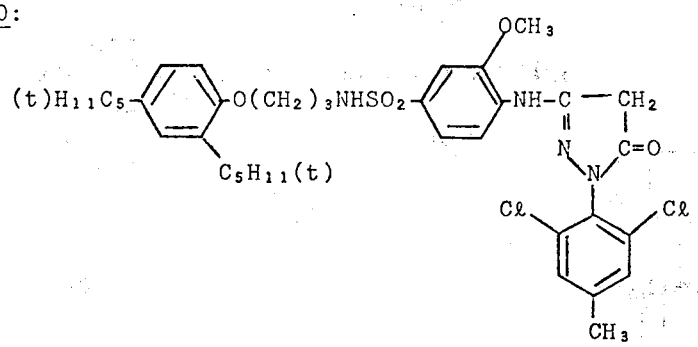
Cp-11:
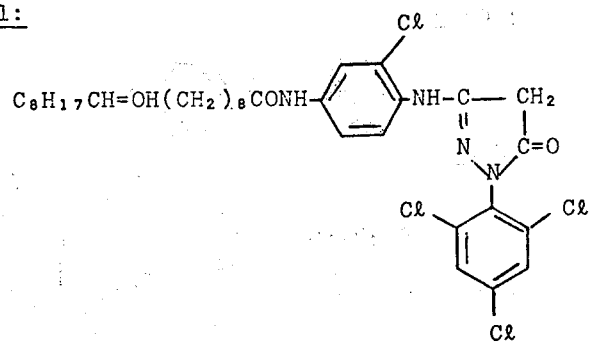
Cp-12:
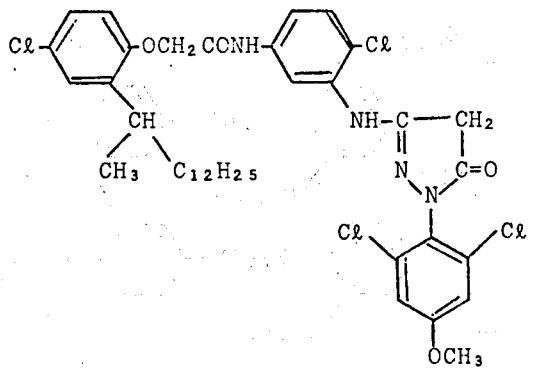
Cp-13:
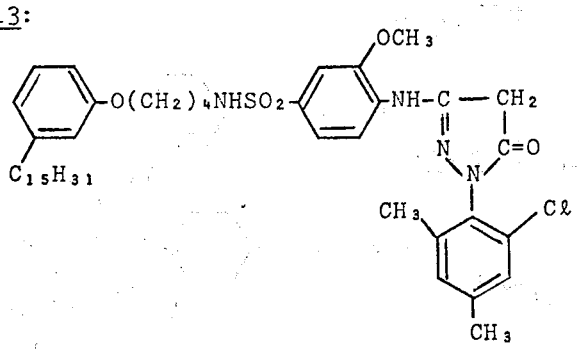

Cp-14:
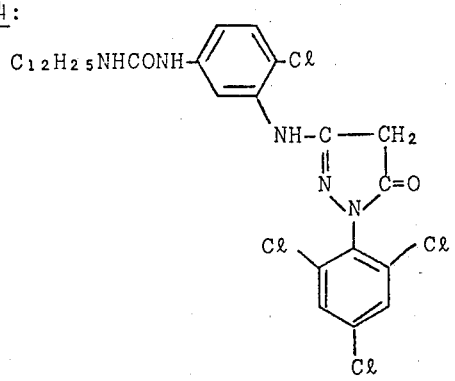
Cp-15:
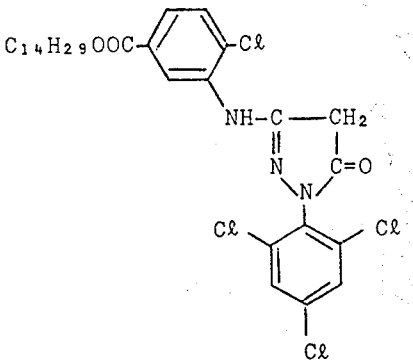
Cp-16:
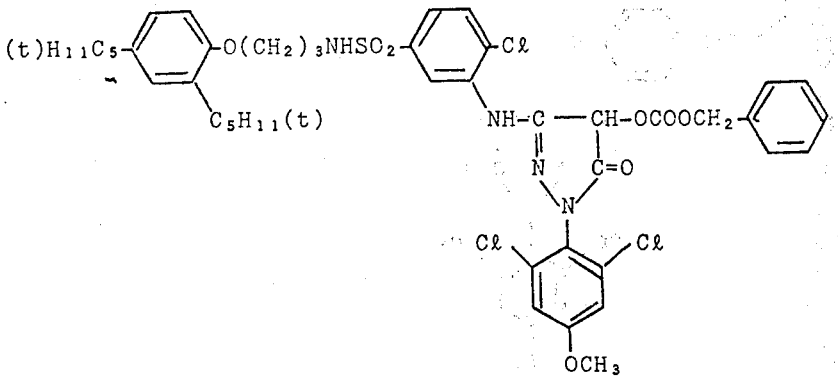
Cp-17:
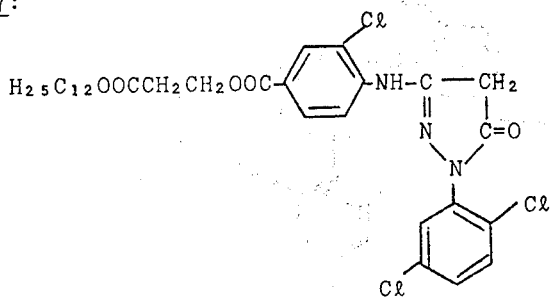

Cp-18:
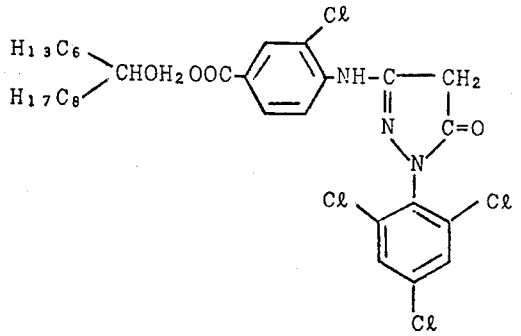
Cp-19:
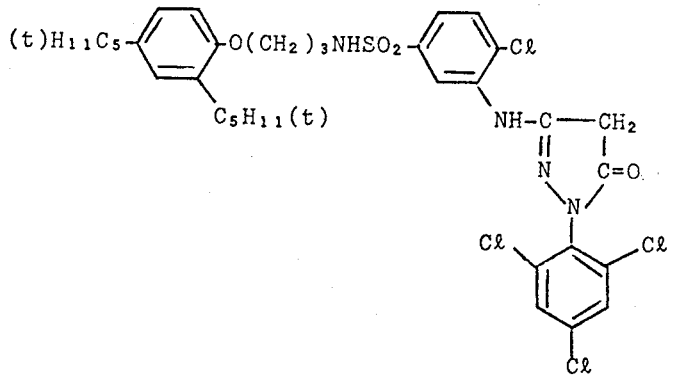
Cp-20:
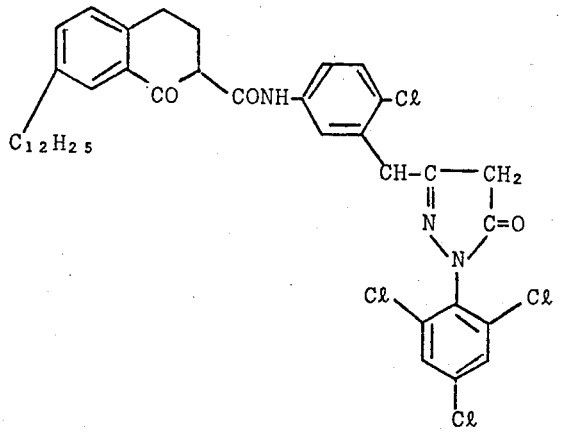
Cp-21:
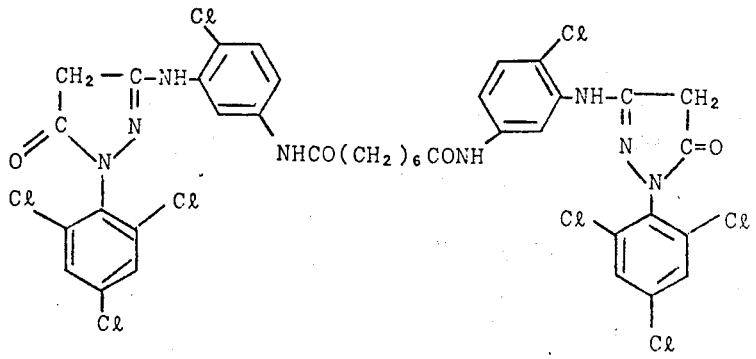

Cp-22:
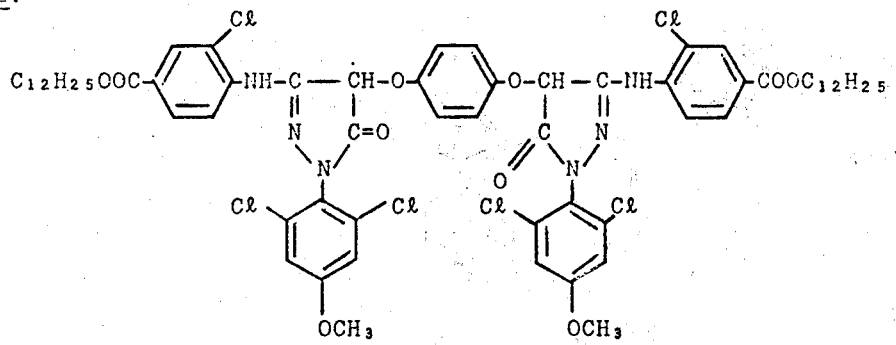
Cp-23:
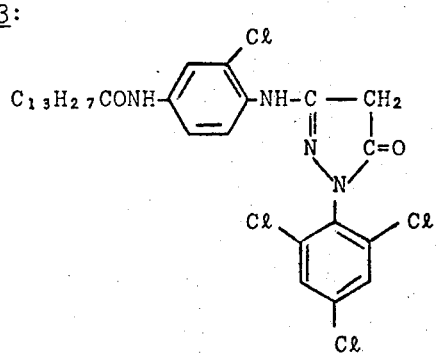
Cp-24:
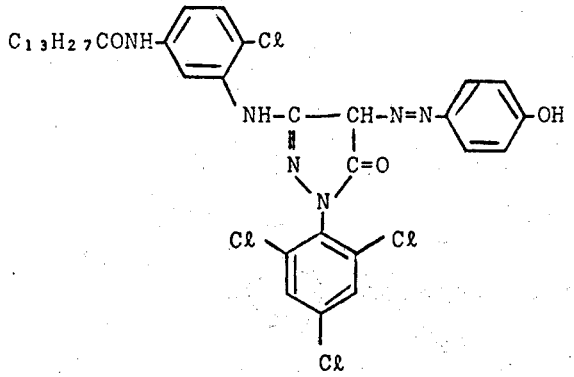
Cp-25:
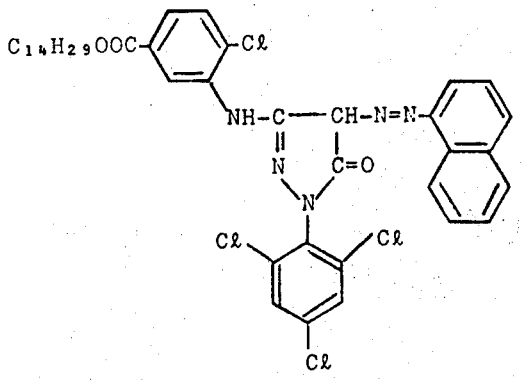

Cp-26:
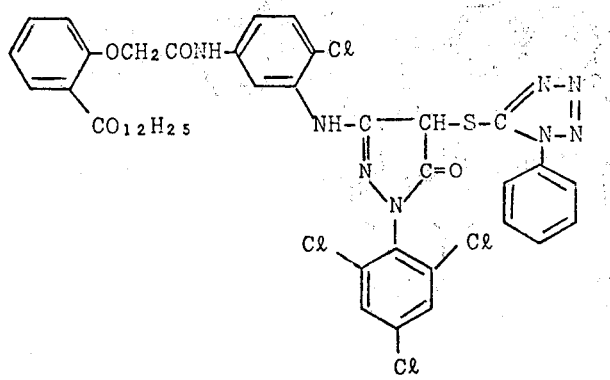
Cp-27:
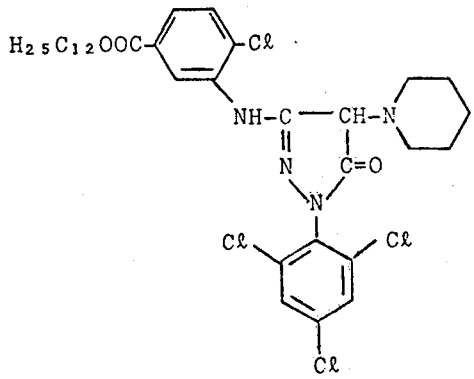
Cp-28:
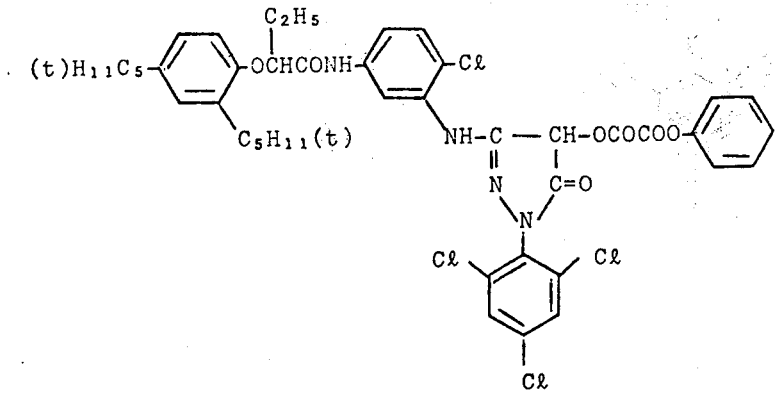
Cp-29:
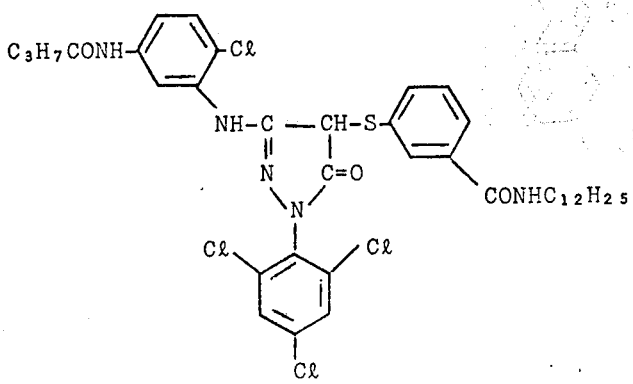

Cp-30:

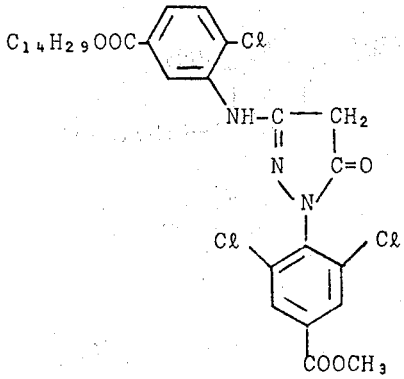

Cp-31:

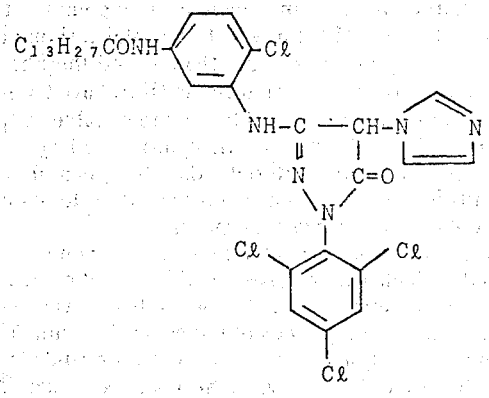

The magenta dye forming couplers which can be used in this invention can be prepared according to the methods as described in, for instance, U.S. Pat. Nos. 3,419,391; 3,615,506; 3,677,764; 3,127,269; 3,684,514; 3,761,274; and 3,694,214; U.S. Pat. application Ser. Nos. 415,864, filed Nov. 13, 1973, 415,853, filed Nov. 14, 1973 and 445,032, filed Feb. 22, 1974, Japanese Pat. No. 19,032/1971 and Japanese Pat. application No. 4816/1973.

The phenolic compounds having an ether bond at the 4-position and having the property of improving the fastness to light of the magenta dye images formed from the above-described magenta dye forming couplers which can be used in this invention include the compounds represented by general formulae (III-*a*), (III-*b*), (III-*c*);

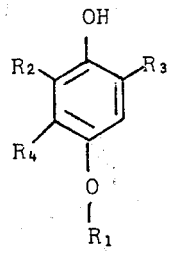

(III-a)

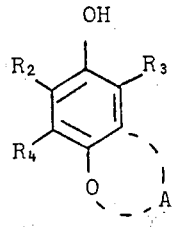

(III-b)

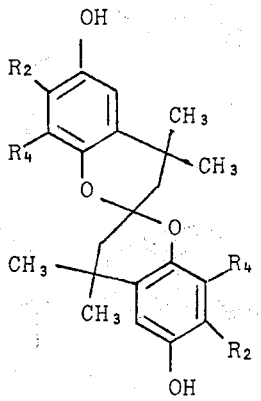

(III-c)

wherein $R_1$ represents an alkyl group (such as a methyl group, a tert-butyl group, a hexyl group, an octyl group, a tert-octyl group, an octadecyl group, etc.); an aryl group (such as a phenyl group, etc.); an aralkyl group (such as a benzyl group, a phenethyl group, etc.); or a terpenyl group (such as a 7,7-dimethylcarbonyl group, et.); $R_2$, $R_3$ and $R_4$, which may be the same or different, each represents a hydrogen atom; an alkyl group (such as a methyl group, a tert-butyl group, a cyclopentyl group, a cyclohexyl group, an octyl group, a dodecyl group, an octadecyl group, etc.); an alkoxy group (such as a methoxy group, a butoxy group, a dodecyloxy group, etc.); an aryl group (such as a phenyl group, etc.); an aryloxy group (such as a phenoxy group, etc.); an aralkyl group (such as a benzyl group, a phenethyl group, etc.); an aralkoxy group (such as a benzyloxy group, a phenethyloxy group, etc.); an alkenyl group (such as an allyl group, etc.); an alkenoxy group (such as allyloxy group, etc.); an acylamino group (such as an acetylamino group, a benzoylamino group, etc.); a halogen atom (such as a chlorine atom, etc.); and A represents a non-metallic atom necessary for completing a 5-membered or 6-membered ring containing a

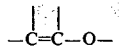

grouping and the ring can be substituted with an alkyl group (such as a methyl group, a tert-butyl group, a cyclohexyl group, an octyl group, a dodecyl group, an octadecyl group, etc.); an alkoxy group (such as a methoxy group, a butoxy group, a dodecyloxy group, etc.); an aryl group (such as a phenyl group, etc.); an aryloxy group (such as a phenoxy group, etc.); an aralkyl group (such as a benzyl group, a phenethyl group, etc.); an aralkoxy group (such as a benzyoxy group, a phenethyloxy group, etc.); an alkenyl group (such as an allyl group, etc.); an alkenoxy group (such as an allyloxy group, etc.); an N-substituted amino group (such as an alkylamino group, a dialkylamino group, an N-alkyl-N-arylamino group, a piperazino group, a morpholino group, etc.); or a heterocyclic ring (such as a benzothiazolyl ring, a benzoxazolyl ring, an imidazolyl ring, an oxazolyl ring, etc.). Furthermore, the aforesaid ring can be substituted with a residue forming a condensed ring. Also, the alkyl group and the aryl group as described above can be substituted with a halogen atom, a hydroxyl group, a carboxyl group, an alkoxycarbonyl group, an acyloxy group, a sulfo group, a sulfonyloxy group, an amido group (e.g., an acetamido group, an ethanesulfonamido group, a benzamido group, etc.), an alkoxy group, or an aryloxy group.

The phenolic compounds of the general formula (III*a*) in which the total carbon atoms of $R_1$, $R_2$, $R_3$ and $R_4$ is larger than 8, the phenolic compounds of the general formula (III*b*) in which the total carbon atoms of $R_2$, $R_3$, $R_4$ and A is larger than 8, and the phenolic compounds of the general formula (III*c*) have the property of low diffusibility and hence are suitable for positioning selectively in a specific hydrophilic layer of the color photographic material. Also, the phenolic compounds having a total carbon atoms of up to about 40 are suitable for ordinary purposes.

Particularly useful compounds of the phenolic compounds which can be used in this invention are the 5-hydroxycoumarans and the 6-hydroxychromans which are the compounds of the general formula (III*b*) where one of $R_2$ and $R_3$ is a hydrogen atom and also the 6,6′-dihydroxy-bis-2,2′-spirochromans represented by the general formula (III*c*).

Specific examples of the phenolic compounds which can be used in this invention are shown below:

Ph-1:

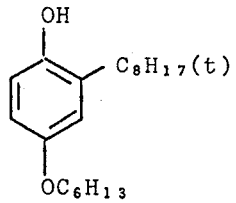

Ph-2:

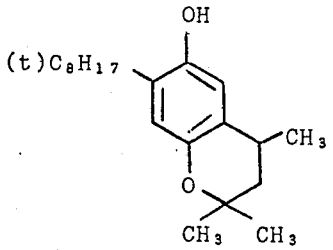

Ph-3:

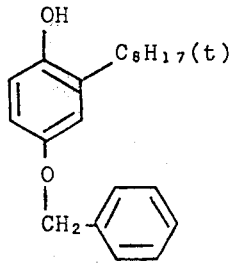

Ph-4:

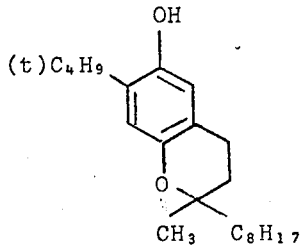

Ph-5:

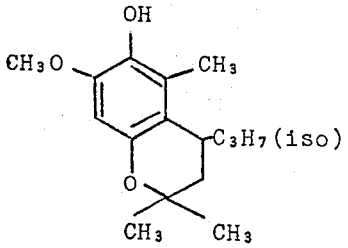

Ph-6:

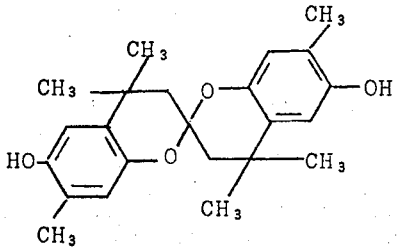

Ph-7:

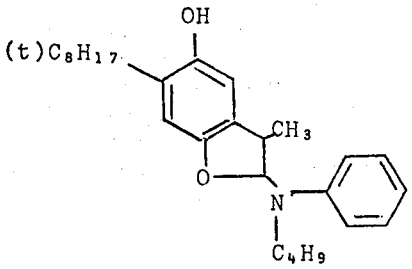

Ph-8:

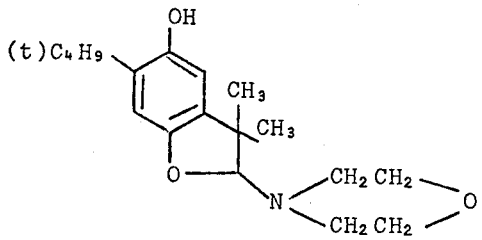

Ph-9:

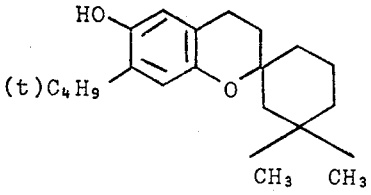

Ph-10:

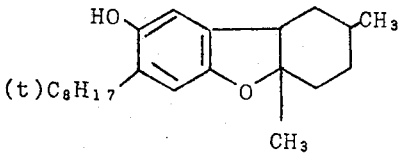

Ph-11:
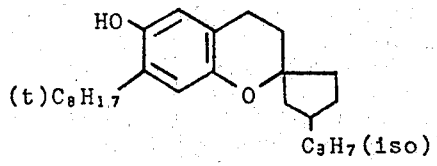
Ph-12:
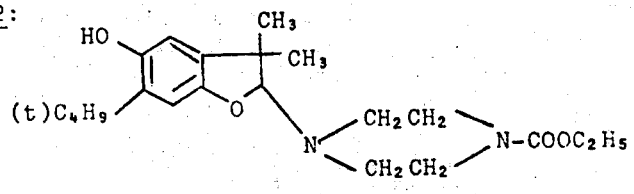
Ph-13:
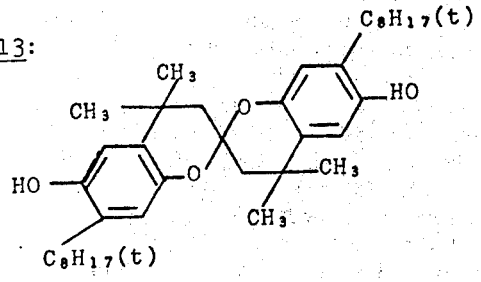
Ph-14:
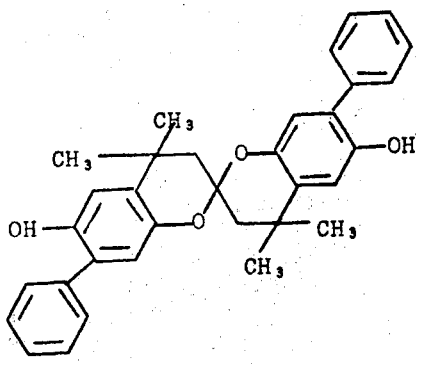

The phenolic compounds which can be used in this invention can be prepared according to the methods described in U.S. Pat. Nos. 2,535,058; 3,184,457; 3,285,937; 3,432,300; and 3,698,909 and German Offenlegungsschriften Nos. 2,005,301; 2,008,376; 2,140,309; 2,146,668; and 2,165,371.

The nucleus-substituted hydroquinones which can be used in this invention has at the aromatic nucleus of the hydroquinone at least one alkyl group or aryl group bonded directly or through a bonding moiety such as -O-, -CO-, -COO-, -CON<, $-SO_2N<$, etc.

The alkyl group and the aryl group can be substituted with substituents such as a halogen atom, an alkyl group, an aryl group, an alkoxy group, an aryloxy group, a carboxyl group, an alkoxycarbonyl group, an aryloxycarbonyl group, an acyl group, an acyloxy group, a carbamoyl group, a sulfo group, a sulfamoyl group, a sulfonamido group, an N-alkylamino group, an N-arylamino group, an acylamino group, an imido group, a hydroxyl group, etc., and these substituents themselves can be further substituted. Furthermore, the divalent moieties corresponding to these groups can be employed to give rise to compounds in which two or more units containing hydroquinone are bonded to each other. Also, the remaining hydrogen atoms of the aromatic nucleus of the hydroquinone can be substituted with the aforesaid substituents as well as with halogen atoms.

Moreover, the hydroquinones which can be used in this invention include the precursors thereof. The term "precursor" as used herein means a compound capable of releasing a hydroquinone on hydrolysis. Examples of such precursors are, for instance, hydroquinone compounds in which one or two hydroxyl groups thereof have been acylated, e.g., have been converted into a grouping such as

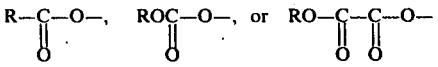

wherein R represents an aliphatic group, e.g., having 1 to 18 carbon atoms, such as an alkyl group, alkenyl group, etc.

The nucleus-substituted hydroquinones used in this invention include the compounds represented by the following general formula (IV);

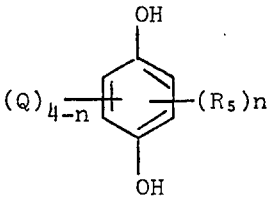

wherein $R_5$ represents an alkyl group (such as a methyl group, a tert-butyl group, an octyl group, a tert-octyl group, a dodecyl group, an octadecyl group, etc.); an aryl group (such as a phenyl group, etc.); an alkoxy group (such as a methoxy group, a butoxy group, a dodecyloxy group, etc); an aralkyl group (such as a benzyl, a phenethyl, etc.); an aralkoxy group (such as a benzyloxy, etc.); an aryloxy group (such as a phenoxy group, etc.); a carbamoyl group (such as a methylcarbamoyl group, a dibutylcarbamoyl group, an octadecylcarbamoyl group, a phenylcarbamoyl group, etc.); a sulfamoyl group (such as a methylsulfamoyl group, an octadecylsulfamoyl group, etc.); an acyl group (such as a lauroyl group, etc.); an alkoxycarbonyl group (such as a methoxycarbonyl group, a dodecylcarbonyl group, etc.); or an aryloxycarbonyl group (such as a phenyloxycarbonyl group, etc.); Q represents a hydrogen atom or a halogen atom (such as chlorine, bromine, iodine or fluorine) and *n* is an integer of 1 to 4.

Furthermore, the aforesaid alkyl group and the aryl group can be substituted with a substituent such as a halogen atom, an alkyl group, an aryl group, an alkoxy group, an aryloxy group, a carboxyl group, an alkoxycarbonyl group, an aryloxycarbonyl group, an acyl group, an acyloxy group, a carbamoyl group, a sulfo group, a sulfamoyl group, an N-arylamino group, an acylamino group, an imido group, and a hydroxyl group. Also, Specific examples of nucleus-substituted hydroquinones which can be used in this invention are described in, e.g., U.S. Pat. Nos. 2,336,327; 2,360,290; 2,384,658; 2,403,721; 2,418,613; 2,675,314; 2,701,197; 2,704,713; 2,710,801; 2,722,556; 2,728,659; 2,732,300; 2,735,765; 2,816,028; 3,062,884; and 3,236,893; British Pat. Nos. 557,750 and 557,802; German Offenlegungsschrift 2,149,789; Japanese Patent Publication No. 54,116/1969; and Japanese Patent Application Laid Open No. 2128/1971 as well as in *Journal of Organic Chemistry*, vol. 22, pages 772 – 774.

Of the aforesaid nucleus-substituted hydroquinones, the compounds in which the total number of carbon atoms contained in the substituents on the nucleus are 8 or more have the property of low diffusibility and hence this property can be suitably used to selectively position these compounds in a specific hydrophilic layer of a photographic material.

Particularly useful hydroquinones in this invention are those containing substituted or unsubstituted alkyl groups at the nucleus.

Specific examples of the hydroquinones which can be used in this invention are shown below:

Hq-1:

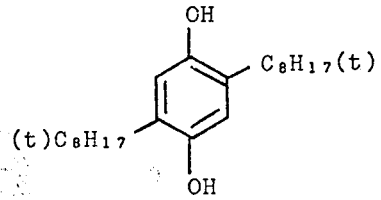

Hq-2:

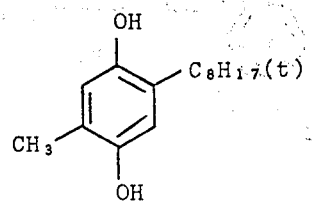

Hq-3:
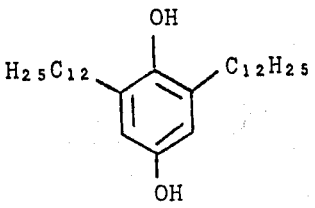
Hq-4:
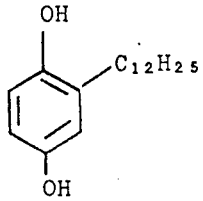
Hq-5:
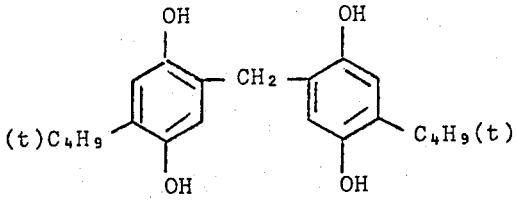
Hq-6:
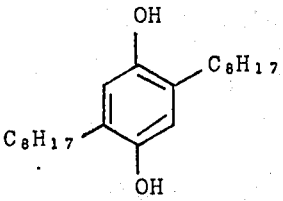
Hq-7:
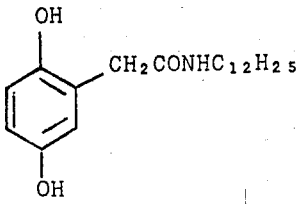
Hq-8:
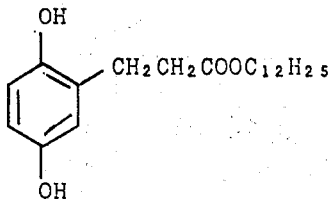
Hq-9:
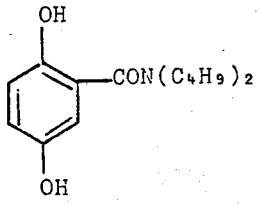
Hq-10:
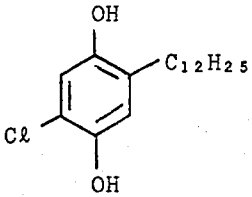
Hq-11:
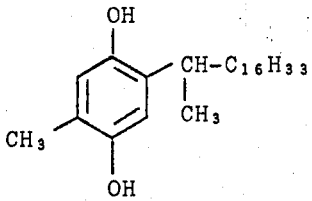
Hq-12:
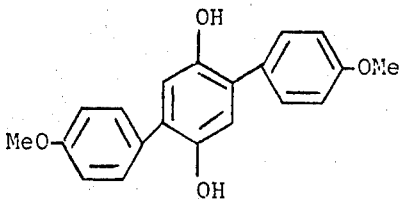

Hq-13:
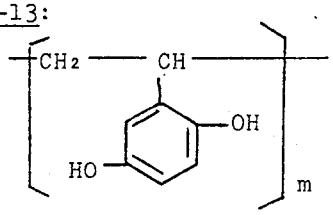
$20 < m < 50$
Hq-14:
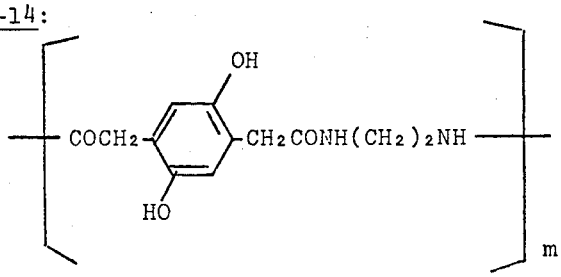
$20 < m < 50$
Hq-15:
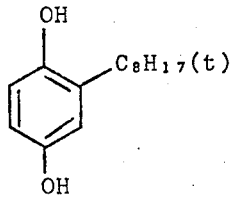
Hq-16:
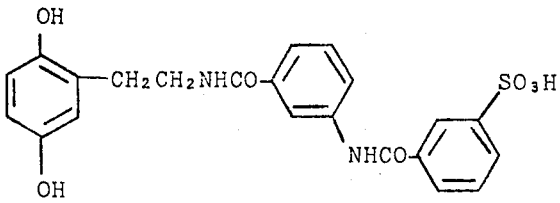
Hq-17:
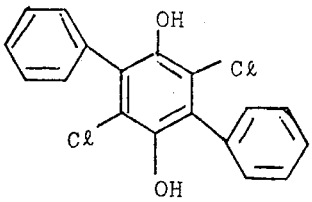
Hq-18:
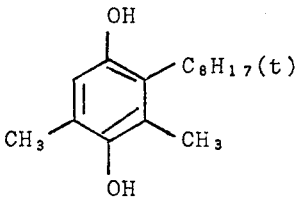
Hq-19:
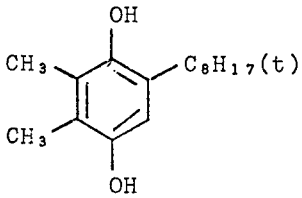
Hq-20:
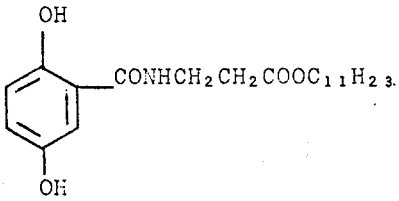

Hq-21:

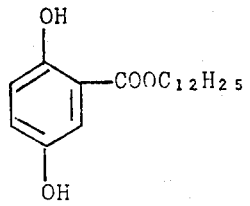

Hq-22:

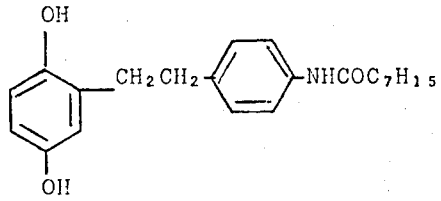

The hydroquinones which can be used in this invention can be prepared according to the methods described in. e.g., U.S. Pat. Nos. 2,336,327 and others as indicated above.

The 3-substituted anilino-5-pyrazolone type magenta forming couplers which can be used in this invention can be employed individually or as a combination thereof or further can be used, if desired, together with other colorless or colored 2-equivalent or 4-equivalent magenta dye forming coupler or couplers. Suitable examples of other couplers are described in, e.g., U.S. Pat. Nos. 2,369,489; 2,600,788; 2,725,292; 2,908,573; 3,062,653; 3,311,476; 3,419,391; 3,558,319; and British Pat. No. 1,249,391.

The magenta forming coupler used in this invention is introduced into a silver halide emulsion layer of a color photographic material in a conventional manner. Typical methods of adding the coupler to a silver halide photographic emulsion are illustrated below:

1.

The coupler is dissolved in an organic solvent which is substantially immiscible with water and having a high boiling point (higher than 200°C), the coupler solution is dispersed in an aqueous medium, and the dispersion is mixed with a photographic emulsion. As the organic solvent used in this method, there are illustrated di-n-butyl phthalate, tricresyl phosphate, N,N-diethylcaproic acid amide, p-n-nonylphenol, 2-methyl-4-n-octylphenol, dioctylbutyl phosphate, acetyl-tributyl citrate, and trioctylmellitate.

2. The coupler is dissolved in an organic solvent which is less immiscible with water and has a low boiling point (e.g., about 20°C to about 170°C), the coupler solution is dispersed in an aqueous medium, and the dispersion is mixed with a photographic emulsion. As the organic solvent suitably used in this method, there are illustrated ethyl acetate, cyclohexanone, β-n-butylethoxyethyl acetate, etc.

3. The coupler is dissolved in an organic solvent which is miscible with water and the coupler solution is added to a photographic emulsion. The organic solvent used may be removed during the production steps of the photographic materials or may be left in the silver halide emulsion layers. As the organic solvent suitably used in this method, there are dimethylformamide, dimethylsulfoxide, N-methylpyrrolidone, glycerine, tetrahydrofuran, diethylene glycol monoacetate, diacetone alcohol, acetonitrile, methyl isobutyl ketone, etc.

4. The coupler is dissolved in an alkaline aqueous solution and the coupler solution is added to a photographic emulsion.

If desired, an appropriate combination of the organic solvents used in methods (1), (2), and (3) described above can be used and further the solvent used in method (3) can be mixed with the solvent used in method (4). Moreover, the aqueous medium in which the organic solvent solution of the magenta dye forming coupler is dispersed can contain a hydrophilic polymer. It is desirable that such a hydrophilic polymer be quite compatible with the hydrophilic binder in the photographic emulsion to which the coupler dispersion is added. An appropriate polymer which can be used for such purpose can be selected from those materials used as binders for photographic emulsions.

The phenolic compounds which can be used in this invention can be used individually or as a combination of two or more such compounds.

The amount of the phenolic compound is usually about 0.01 mol to about 10 mols per mol of the magenta forming coupler but a particularly preferred amount is about 0.1 mol to about 2 mols per mol of the magenta forming coupler. A suitable coating amount of the magenta coupler ranges from about $3 \times 10^{-3}$ to about $1 \times 10^{-4}$ mol/m$^2$, preferably $2 \times 10^{-3}$ to $3 \times 10^{-4}$ mol/m$^2$ of the support. A suitable coating amount of silver ranges from about $3 \times 10^{-2}$ to about $2 \times 10^{-4}$ mol/m$^2$, preferably $2 \times 10^{-2}$ to $6 \times 10^{-4}$ mol/m$^2$ of the support.

The hydroquinones used in this invention can be used individually or as a combination of two or more such compounds. The amount of the hydroquinone added is usually from about 0.01 mol to about 10 mols, preferably from about 0.1 mol to about 2 mols per mol of the magenta forming coupler.

The phenolic compound and the nucleus-substituted hydroquinone can be added to a photographic emulsion in a conventional manner according to the method stated above in regard to the magenta dye forming coupler.

The magenta dye forming coupler, the phenolic compound, and the hydroquinone can be added to a photographic emulsion as separate solutions or dispersions or can be added to the photographic emulsion as a mixture of two or three kinds of solutions of dispersions thereof.

The silver halide emulsion which can be used in this invention can be suitably selected from various kinds of photographic emulsions depending on the end-use purposes of the photographic materials. Suitable silver halides which can be used in this invention are silver chloride, silver chlorobromide, silver bromide, silver iodobromide, and silver chloroiodobromide. Also, suitable binders for the silver halide emulsions which can be used in this invention are gelatin, gelatin derivatives (e.g., the acrylated gelatin as described in U.S. Pat. No.

3,118,766 and the graft gelatin having as the branch component a vinyl monomer such as acrylic acid as described in U.S. Pat. No. 2,831,767), casein, albumin, agar agar, sodium alginate, starch, cellulose derivatives (e.g., carboxymethyl cellulose and hydroxyethyl cellulose), vinyl alcohol, vinylpyrrolidone, polyacrylamide, and the like.

The silver halide emulsions used in this invention can be prepared by a single jet method, a double jet method, a control double jet method, and further the halogen conversion method as described in British Pat. No. 635,841 and U.S. Pat. No. 3,622,318.

The silver halide emulsion used in this invention can be sensitized by the natural sensitizers present in gelatin, by a sulfur sensitizer, by a reductive sensitizer, and by a noble metal salt using conventional techniques. Suitable examples of chemical sensitizers are auric compounds such as auric chloride compounds or auric trichloride compounds as disclosed in U.S. Pat. Nos. 2,399,083; 2,540,085; 2,597,856; 2,597,915; etc.; noble metal salts of platinum, palladium, iridium, rhodium, or ruthenium as disclosed in U.S. Pat. Nos. 2,448,060; 2,540,086; 2,566,245; 2,566,263; 2,598,079; etc.; sulfur compounds which react with silver salts to form silver sulfide as disclosed in U.S. Pat. Nos. 1,574,944; 2,410,689; 3,189,458; 3,501,313; etc.; reduction compounds of stannous salts or amine group compounds as disclosed in U.S. Pat. Nos. 2,487,850; 2,518,698; 2,521,925; 2,521,926; 2,694,637; 2,983,610; 3,201,254; etc.

The silver halide emulsion can further be stabilized using an agent for forming a sparingly soluble silver salt, such as a mercapto compound, e.g., 1-mercapto-5-phenyltetrazole and/or a stabilizer such as 5-methyl-6-oxy-1,3,4-triazaindolizine. For example, the photographic emulsion can contain compounds added to prevent a reduction in the sensitivity and fogging during the manufacturing process or on storage. Typical compounds are 4-hydroxy-6-methyl-1,3,3a,7-tetrazaindene, 3-methyl-benzothiazole, 1-phenyl-5-mercaptotetrazole, heterocyclic compounds, mercury containing compounds, mercapto compounds, and metal salts. Additional examples which can be used are disclosed in Mees and James, *The Theory of the Photographic Process* (3rd Edition, 1966), and also in, U.S. Pat. Nos. 1,758,576; 2,110,178; 2,131,038; 2,173,628; 2,697,040; 2,304,962; 2,324,123; 2,494,198; 2,444,605; 2,444,606; 2,444,607; 2,444,608; 2,566,245; 2,694,716; 2,697,099; 2,708,162; 2,728,663; 2,728,664; 2,728,665; 2,476,536; 2,824,001; 2,843,491; 2,886,437; 3,052,544; 3,137,577; 3,220,839; 3,226,231; 3,236,652; 3,251,691; 3,252,799; 3,287,135; 3,326,681; 3,420,668; 3,622,339; and British Pat. Nos. 893,428; 403,789; 1,173,609; 1,200,188. Furthermore, the photographic emulsion can contain a sensitizing dye such as a cyanine dye and merocyanine dye as described in U.S. Pat. Nos. 2,688,545; 2,912,329; 3,397,060; 3,615,635 and 3,628,964, British Pat. Nos. 1,195,302; 1,242,588; and 1,293,862, German Offenlegungsschriften Nos. 2,030,326, and 2,121,780, Japanese Patent Publication Nos. 4936/68, and 14030/69, and further a coating aid such as saponin, polyethyleneglycol monolauryl ether, etc., for example, as described in U.S. Patent Nos. 2,271,623; 2,240,472; 2,288,226; 2,739,891; 3,068,101; 3,158,484; 3,201,253; 3,210,191; 3,294,540; 3,415,649; 3,441,413; 3,442,654; 3,475,174; 3,545,974, etc. Furthermore, the silver halide emulsion can contain a thickener such as polystyrenesulfonic acid, etc., a ultraviolet absorber such as 2-(2-hydroxy3,5-di-sec-butylphenyl)-5-methoxybenzotraizole, 4-methoxy-α-cyanocinnamic acid-n-dodecyl ester, etc., as disclosed in U.S. Patent Nos. 2,685,512; 2,739,888; 2,719,086; 2,739,971; 2,747,996; 2,784,087; 3,253,921; 3,533,794; 3,004,896; 3,159,646 and 3,214,436, an antioxidant or a reducing agent such as sodium bisulfite, ascorbic acid, an aminophenol, a pyrogallol, gallic acid, a catechol, a resorcinol, and dihydroxynaphthalene, and an irradiation preventing dye such as an oxonole dye and a styryl dye.

The photographic material of this invention comprises a support having coated thereon at least the silver halide emulsion layer containing the 3-substituted anilino-5-pyrazolone type magenta forming coupler, the phenolic compound, the nucleus-substituted hydroquinone. According to one embodiment of this invention the photographic color material comprises a support having thereon a blue-sensitive silver halide emulsion layer containing a yellow dye forming coupler, a green-sensitive silver halide emulsion layer containing a magenta dye forming coupler, the phenolic compound, and the nucleus-substituted hydroquinone of this invention, and a red-sensitive silver halide emulsion layer containing a cyan dye forming coupler. The blue-sensitive silver halide emulsion layer and the red-sensitive silver halide emulsion layer of the photographic material can be those usually employed in the color photographic field.

As the yellow dye forming coupler, a open chain type ketomethylene compound such as a benzoylacetamide type compound and a pivaloylacetamide type compound can be advantageously used. Useful non-diffusible yellow dye-forming couplers are exemplified or suggested in U.S. Pat. Nos. 2,778,658; 2,875,057; 2,908,573; 3,227,550; 3,253,924; 3,227,155; 3,408,194; 3,447,928; 3,415,652; 3,384,657; 3,369,895; 3,265,506; and 3,227,554. Also, as the cyan dye forming coupler, a phenolic compound or a naphtholic compound is advantageously used. Ballasted non-diffusible cyan dye forming couplers suitable for use in the present invention are exemplified or suggested in U.S. Pat. Nos. 2,373,293; 2,423,730; 2,801,171; 2,895,826; 2,908,573; 3,046,129; 3,516,831; 3,331,476; 3,253,294; 3,458,315; 3,227,550; 3,476,563; 3,419,390 and 3,034,892.

Each of these dye forming couplers can contain a coupling releasing group at the carbon atom of the coupling position thereof. It is desirable that the dye forming couplers be nondiffusible.

The color photographic material of this invention can have, in addition to the aforesaid silver halide emulsion layers, auxiliary layers such as a protective layer, a filter layer, intermediate layers, an antihalation layer, and a backing layer.

The hydrophilic polymer, particularly gelatin constituting the silver halide emulsion layers of the color photographic material of this invention can be hardened by various cross linking agents, e.g., an inorganic compound such as a chromium salt and a zirconium salt, and an aldehyde type cross linking agent as described in Japanese Pat. No. 1872/1971. Examples of hardening agents which can be employed for this purpose are aldehyde compounds such as formaldehyde, glutaraldehyde, etc.; ketone compounds such as diacetyl, cyclopentandione, etc.; reactive halogen containing compounds such as bis-(2-chloroethyl-urea) and 2-hydroxy-4,6-dichloro-1,3,5-triazine, as disclosed in U.S. Pat. Nos. 3,288,775 and 2,732,303, British Pat. Nos. 974,723 and 1,167,207; compounds having a reactive olefinic group such as divinylsulfone, 5-acetyl-1,3-diacryloylhexahydro-1,3,5-triazine, etc., as described in the specifications of U.S. Pat. Nos. 3,635,718 and 3,232,763 and British Pat. No. 994,869; the N-methylol compounds such as N-hydroxymethylphthalimide, etc., as described in the specifications of U.S. Pat. Nos. 2,732,316 and 2,586,168; the isocyanates as described in the specification of U.S. Pat. No. 3,103,437; the organic carboxylic acid or sulfonic acid derivatives as described in the specifications of U.S. Pat. Nos. 2,725,294 and 2,725,295; the carbodiimide compounds as described in the specification of U.S. Pat. No. 3,100,704; the epoxy compounds as described in the specification of U.S. Pat. No. 3,091,537; the isooxazole compounds as described in the specifications of U.S. Pat. Nos. 3,321,313 and 3,543,292; halocarboxyaldehydes such as mucochloric acid; dioxane derivatives such as dihydroxydioxane, dichlorodioxane, etc.; and inorganic hardening agents such as chromium alum, zirconium sulfate, etc.

Also, precursors such as, for instance, an alkali metal bisulfite-aldehyde addition product, a methylol derivative of hydantoin, and a primary aliphatic nitro alcohol can be used instead of the above-described compounds as the hardening agent.

However, particularly useful cross linking agents which can be used in this invention are the polyepoxy compounds as described in Japanese Pat. No. 7133/1959, the poly-(1-aziridinyl) compounds as described in Japanese Pat. No. 8790/1962, and the active halogen compounds as described in U.S. Pat. Nos. 3,362,827 and 3,325,287.

In the color photographic materials of this invention, any materials usually used as supports for photographic materials can be suitably used. For instance, preferred examples of such supports are cellulose ester films such as cellulose nitrate films, cellulose acetate films, etc., polyester films such as polyester films, polystyrene films, etc., polyvinyl chloride films, polyvinyl acetal films, polystyrene films, polycarbonate films, polyamide films such as nylon films, baryta-coated papers, $\alpha$-olefin polymer-coated papers, etc.

The color photographic material of this invention can be used for various purposes such as color positive films, color negative films, color reversal films, color papers, etc.

The color photographic material of this invention is imagewise exposed and then subjected to conventional color processing steps to obtain a magenta image having excellent spectral characteristics and image fastness. The main color processing steps are color development, bleach, and fix and if desired a wash step can be inserted between the steps.

A useful color developer which can be used for developing the color photographic material of this invention is an alkaline aqueous solution containing a color developing agent. Examples of color developing agents which can be used in the color developer include conventional primary aromatic amine color developing agents such as a phenylenediamine (e.g., N-diethyl-p-phenylenediamine, N-ethyl-N-$\beta$-hydroxyethyl p-phenylenediamine, 4-(N-ethyl-N-$\beta$-hydroxyethyl-)amino-2-methylaniline, 4-(N-ethyl-N-$\beta$-methylsulfonamidoethyl)amino-2-methylaniline, 4-(N-ethyl-N-methoxyethyl)-2-methylaniline, 4-(N,N-diethylamino)-2-methylaniline, and N,N-diethylamino-2-ethoxyaniline) and a p-amino-phenol (e.g., 4-aminophenol, 2,6-dichloro-4-aminophenol, 2-bromo-4-aminophenol, and 2,6-diioso-4-aminophenol).

The color developer can contain further conventional additives such as, for instance, an alkali metal sulfite, an alkali metal carbonate, an alkali metal bisulfite, a bromide, an iodide, an alkaline buffer, etc. Furthermore, if desired, the color developer can contain a dye forming coupler, a competitive coupler, an antifoggant, a hardening agent, an antioxidant, a thickener, etc.

Suitable developing agents and developers are disclosed in, for example, C.E.K. Mees and T.H. James, *The Theory of the Photographic Process*, pp. 294 – 295 (1966), and in U.S. Pat. Nos. 2,592,364; 2,193,015; 3,042,520; and 3,241,966, etc.

The color photographic material of this invention can form a magenta dye image having excellent spectral characteristics by color development. A feature of this invention is that the present invention particularly advantageous in the color reproduction of multi-color photography. Since the magenta dye image formed using the color photographic material of this invention has quite a high fastness to light, heat, and moisture and has less yellowing or print-out caused by the residual coupler in the highlight areas, the original image quality can be retained even if the processed color photographic material is stored for a long period of time. As a result of these excellent features, in the case of employing the color photographic material of this invention, stabilization using formaldehyde becomes unnecessary and thus the color photographic process can be simplified. Furthermore, when the color photographic material of this invention is exposed and developed after storing for a long period of time, the coupling density thereof is not reduced.

The color photographic materials of this invention having the aforesaid advantages are quite useful in the field of color photography.

The invention will be explained in greater detail by reference to the following examples. Unless otherwise indicated, all parts, percents, ratios and the like are by weight.

EXAMPLE 1

A mixture of the components shown in Table 1 below was heated on a steam bath to dissolve the components and after adding the solution to 100 ml of an aqueous solution containing 10 g of gelatin and 0.5 g of sodium dodecylbenzenesulfonate, the mixture was stirred using a homogenizer to provide a coupler dispersion. This dispersion was mixed with 200 g of a photographic silver halide emulsion containing $11.2 \times 10^{-2}$ mols of silver chlorobromide (containing 50 mol percent silver chloride) and 20 g of gelatin and after adding to the mixture 8 ml of a 4% acetone solution of 2-hydroxy-4,6-dichloro-s-triazine sodium salt and adjusting the pH to 6.5, the resultant mixture was coated on a cellulose triacetate film in a dry thickness of 3 microns. Thus, Samples 1 to 12 were prepared.

TABLE I

| Sample | Coupler | Phenolic Compound | Hydro-quinone | Tricresyl Phosphate | Ethyl Acetate |
|---|---|---|---|---|---|
| 1 | (A): 9.8g | — | — | 14 ml | 25 ml |
| 2 | " | Ph-2:2g | — | 14 " | 30 " |
| 3 | " | — | Hq-1: 1g | 14 " | 30 " |
| 4 | (A): 9.8g | Ph-2: 2g | " | 14 " | 32 " |
| 5 | Cp-1 : 9.8g | — | — | 14 " | 25 " |
| 6 | " | Ph-2: 2g | — | 14 " | 30 " |
| 7 | " | — | Hq-1: 1g | 14 " | 30 " |
| 8 | " | Ph-2: 2g | " | 14 " | 32 " |
| 9 | Cp-19: 10.4g | — | — | 14 " | 25 " |
| 10 | " | Ph-6: 1g | — | 14 " | 30 " |
| 11 | " | — | Hq-3: 1g | 14 " | 30 " |
| 12 | " | Ph-6: 1g | " | 14 " | 32 " |

(A): Comparison coupler: 1-(2,6-dichloro-4-methoxyphenyl)-3-[ α(2,4-di-tert-amylphenoxy)butyramido benzamido]-5-pyrazolone.

After storing the samples for 5 days at 25°C and a relative humidity (RH) of 60%, the samples were exposed through an optical wedge and subjected to the following processings;

| | Step | Temperature | Time |
|---|---|---|---|
| 1. | Color Development | 30°C | 4 min. |
| 2. | Blix | " | 2 min. |
| 3. | Wash | " | 2 min. |
| 4. | Stabilization | " | 2 min. |

The compositions of the processing solutions used in the above-described process were as follows:

| | |
|---|---|
| Color Developer: | |
| Sodium Metaborate | 25 g |
| Sodium Sulfite | 2 g |
| Hydroxylamine (sulfate) | 2 g |
| Potassium Bromide | 0.5 g |
| 6-Nitrobenzimidazole (nitrate) | 0.02 g |
| Sodium Hydroxide | 4 g |
| Benzyl Alcohol | 15.8 ml |
| Diethylene Glycol | 20 ml |
| 4-(N-Ethyl-N-β-methanesulfonamidoethyl) amino-2-methylaniline.sesquisulfate | 8 g |
| Water to make | 1,000 ml |
| Blix Solution: | |
| Ferric Salt of Ethylenediamine Tetraacetic Acid | 45 g |
| Ammonium Thiocyanate | 10 g |
| Sodium Sulfite | 10 g |
| Aqueous Solution of Ammonium Thisulfate (60%) | 100 ml |
| Tetrasodium Ethylenediamine Tetraacetate | 5 g |
| Water to make | 1,000 ml |
| Stabilization Solution: | |
| Tartaric Acid | 10 g |
| Zinc Sulfate | 10 g |
| Sodium Metaborate | 20 g |
| Water to make | 1,000 ml |

After processing, the spectral absorption of the magenta dye images formed in Samples 3, 7, and 11 was measured. From the spectral absorption curve where the density of the main absorption maximum wave length was 1.0, the density (S value) at a 60 μ longer wave length side of the main absorption wave length, the wave length width (half value width) of a density of 0.5, and the density of a secondary absorption in the blue region were determined. The results obtained are shown in Table 2.

TABLE 2

| Sample | Coupler | S Value | Half Value Width (mμ) | Secondary Absorption Density | Absorption Maximum Wave Length (mμ) |
|---|---|---|---|---|---|
| 3 | (A) | 0.260 | 89 | 0.195 | 541 |
| 7 | 1 | 0.187 | 79 | 0.145 | 541 |
| 11 | 19 | 0.175 | 77 | 0.136 | 543 |

The results in Table 2 showed clearly that the 3-substituted anilino-5-pyrazolone type magenta dye forming couplers used in this invention provided magenta dye images having excellent spectral absorption characteristics showing a sharply cut absorption curve at the longer wave length side and having less undesirable secondary absorptions.

The fastness of the images and the staining condition at the low density portions of the images (highlight portions) in each case when (I) Samples 1 to 12 thus processed were stored in the dark for one week at 80°C, (II) the samples were stored in the dark for two weeks at 60°C and 75% RH, or (III) the samples were exposed for two weeks to a day light fluorescent lamp at an illuminance of about 10,000 lux through a filter substantially absorbing ultraviolet rays of wave lengths shorter than 400 μ (Fuji Film Filter UV-400, made by Fuji Photo Film Co., Ltd.) were observed. The evaluation of the fastness of image was made by measuring the densities of the image at the portions having initial densities of 0.5, 1.0, and 2.0 (green light) after the forced deterioration test and then calculating the density reduction ratio (%) with respect to the initial density. Also, the staining condition was evaluated by the density value of the highlight portion of the color image measured by blue light after the forced deterioration test. The results obtained are shown in Table 3.

TABLE 3

| Sample | One Week at 80°C Image Fastness Initial Density | | | Stain | Two Weeks at 60°C,75% RH Image Fastness Initial Density | | | Stain | Two Weeks under Fluorescent Lamp Image Fastness Initial Density | | | Stain |
|---|---|---|---|---|---|---|---|---|---|---|---|---|
| | 0.5 | 1.0 | 2.0 | | 0.5 | 1.0 | 2.0 | | 0.5 | 1.0 | 2.0 | |
| 1 | 67 | 51 | 4 | 0.20 | 24 | 19 | 12 | 0.22 | 73 | 36 | 14 | 0.18 |

TABLE 3-continued

| Sample | One Week at 80°C Image Fastness Initial Density | | | Stain | Two Weeks at 60°C,75% RH Image Fastness Initial Density | | | Stain | Two Weeks under Fluorescent Lamp Image Fastness Initial Density | | | Stain |
|---|---|---|---|---|---|---|---|---|---|---|---|---|
| | 0.5 | 1.0 | 2.0 | | 0.5 | 1.0 | 2.0 | | 0.5 | 1.0 | 2.0 | |
| 2 | 65 | 49 | 4 | 0.25 | 20 | 18 | 11 | 0.26 | 42 | 28 | 7 | 0.24 |
| 3 | 66 | 52 | 3 | 0.12 | 23 | 18 | 12 | 0.13 | 60 | 33 | 12 | 0.10 |
| 4 | 64 | 52 | 4 | 0.12 | 22 | 19 | 13 | 0.12 | 38 | 25 | 4 | 0.11 |
| 5 | 7 | 7 | 3 | 0.18 | 7 | 5 | 2 | 0.21 | 42 | 28 | 10 | 0.19 |
| 6 | 7 | 6 | 3 | 0.23 | 7 | 4 | 3 | 0.25 | 10 | 6 | 2 | 0.22 |
| 7 | 6 | 6 | 4 | 0.12 | 8 | 6 | 3 | 0.12 | 34 | 23 | 9 | 0.11 |
| 8 | 6 | 6 | 3 | 0.11 | 7 | 5 | 2 | 0.12 | 8 | 5 | 3 | 0.10 |
| 9 | 10 | 9 | 0 | 0.20 | 11 | 8 | 4 | 0.22 | 49 | 33 | 13 | 0.18 |
| 10 | 9 | 9 | 1 | 0.26 | 12 | 8 | 5 | 0.26 | 13 | 10 | 8 | 0.25 |
| 11 | 10 | 10 | 0 | 0.13 | 12 | 9 | 5 | 0.13 | 39 | 26 | 11 | 0.12 |
| 12 | 9 | 8 | 1 | 0.12 | 11 | 7 | 4 | 0.13 | 12 | 10 | 7 | 0.11 |

As is clear from the results shown in Table 3, when the forced deterioration test was conducted at a high temperature of 80°C for one week, a remarkable reduction in density was observed at the low image density portions in Samples 1 to 4, while the reduction in image density was considerably less in Samples 5 to 12. Also, when the forced deterioration test was conducted at high temperature and high humidity conditions of 60°C and 75% RH for two weeks, the reduction in image density was quite less in Samples 5 to 12 as compared with Samples 1 to 4. These results showed that the 3-substituted anilino-5-pyrazolone magenta dye forming couplers used in this invention could form dye images having excellent fastness to heat and moisture.

The results of the forced deterioration test using a fluorescent lamp, the reduction in image density was less in Samples 5 and 9 as compared with Sample 1. That is, the magenta dye forming couplers used in this invention were also better to some extent in fastness to light of the color images formed as compared with the comparison couplers as shown in the table but the light fastness of the color images formed from the magenta forming couplers of this invention shown in Table 3 was still unsatisfactory. However, the light fastness of the color images formed from the magenta forming couplers used in this invention was greatly improved by using the phenolic compounds of this invention together with the magenta forming couplers (Samples 6 and 10). It is astonishing that the improvement of the light fastness by the use of the phenolic compound was particularly remarkable in the case of using the couplers of this invention as compared with the case of using the comparison couplers. Furthermore, as is clear from the results shown in Table 3, the formation of stains was reduced greatly by using additionally the hydroquinones of this invention together with the above components (Samples 8 and 12).

As is shown above, when the magenta dye forming coupler of this invention is used together with the phenolic compound and the hydroquinone of this invention, a magenta dye image showing less discoloring and fading by the actions of light, heat and moisture and having good spectral absorption characteristics is obtained.

When the aforesaid unexposed samples were stored for 5 months at 25°C and 60% RH, the change in coupling density of the samples was determined. The results obtained are shown in Table 4.

TABLE 4

| Sample | After Five Days Gamma | After Five Days Maximum Coupling Density | After Five Months Gamma | After Five Months Maximum Coupling Density |
|---|---|---|---|---|
| 1 | 2.57 | 2.75 | 2.55 | 2.71 |
| 2 | 2.61 | 2.78 | 1.32 | 1.25 |
| 3 | 2.53 | 2.77 | 2.50 | 2.69 |
| 4 | 2.60 | 2.79 | 2.56 | 2.73 |
| 5 | 2.65 | 2.84 | 2.61 | 2.82 |
| 6 | 2.68 | 2.79 | 1.39 | 1.34 |
| 7 | 2.63 | 2.85 | 2.57 | 2.81 |
| 8 | 2.66 | 2.81 | 2.63 | 2.79 |
| 9 | 2.70 | 2.89 | 2.72 | 2.83 |
| 10 | 2.72 | 2.79 | 1.45 | 1.55 |
| 11 | 2.69 | 2.83 | 2.68 | 2.79 |
| 12 | 2.73 | 2.86 | 2.74 | 2.86 |

From the results shown in Table 4 above, it was confirmed that when Samples 2, 6, and 10 were stored for 5 months, a great reduction in the maximum coupling density was observed. This shows that some interaction occurred between the phenolic compound and the magenta dye forming coupler used for improving the light fastness of color images, which results in reducing the coupling property or activity of the coupler with the passage of time. Such a phenomenon is specific to the phenolic compound used in this invention. On the other hand, when the hydroquinone compound of this invention was used together with the two components according to this invention (Samples 4, 8 and 12), the reduction in such coupling density was completely prevented. That is to say, the use of the combination of the magenta dye forming coupler, the phenolic compound, and the hydroquinone according to the present invention can provide color photographic materials which provide color images having the aforesaid excellent properties while maintaining the storage stability thereof in an unexposed state.

EXAMPLE 2

Samples 1 to 12 as described in Example 1 were stored for 5 days or 5 months at 25°C and 60% RH, then exposed through an optical wedge, and then subjected to the following processings:

| Processing | Temperature | Time |
|---|---|---|
| 1. Color Development | 21°C | 12 minutes |
| 2. Wash | " | 30 seconds |
| 3. First Fix | " | 4 minutes |
| 4. Wash | " | 4 minutes |
| 5. Bleach | " | 8 minutes |
| 6. Wash | " | 4 minutes |
| 7. Second Fix | " | 4 minutes |

-continued

| Processing | Temperature | Time |
|---|---|---|
| 8. Wash | " | 6 minutes. |

The compositions of the processing solutions used in the above processings were as follows:

| | | |
|---|---|---|
| Color Developer: | | |
| Sodium Hexametaphosphate | 2 | g |
| Sodium Sulfite (anhydrous) | 2 | g |
| Benzyl Alcohol | 5 | ml |
| Sodium Carbonate (monohydrate) | 27.5 | g |
| Potassium Bromide | 0.5 | g |
| Hydroxylamine Sulfate | 2.5 | g |
| 4-(N-Ethyl-N-β-methylsulfonamidoethyl) amino-2-methylaniline.sesquisulfate | 2.5 | g |
| Water to make | 1 | l |
| Fix Solution: | | |
| Sodium Thiosulfate (hexahydrate) | 80 | g |
| Sodium Sulfite (anhydrous) | 5 | g |
| Borax | 6 | g |
| Glacial Acetic Acid | 4 | ml |
| Potassium Alum | 7 | g |
| Water to make | 1 | l |
| Bleach Solution: | | |
| Potassium Ferricyanide | 100 | g |
| Potassium Bromide | 5 | g |
| Boric Acid | 10 | g |
| Borax | 5 | g |
| Water to make | 1 | l |

The gamma and the maximum coupling density of each sample after processing are shown in Table 5.

TABLE 5

| Sample | After Five Days | | After Five Months | |
|---|---|---|---|---|
| | Gamma | Maximum Coupling Density | Gamma | Maximum Coupling Density |
| 1 | 2.38 | 2.73 | 2.35 | 2.69 |
| 2 | 2.42 | 2.76 | 1.14 | 1.10 |
| 3 | 2.37 | 2.81 | 2.44 | 2.72 |
| 4 | 2.41 | 2.78 | 2.38 | 2.65 |
| 5 | 2.58 | 2.80 | 2.55 | 2.81 |
| 6 | 2.59 | 2.81 | 1.30 | 1.23 |
| 7 | 2.60 | 2.76 | 2.49 | 2.78 |
| 8 | 2.57 | 2.82 | 2.57 | 2.80 |
| 9 | 2.61 | 2.85 | 2.59 | 2.83 |
| 10 | 2.65 | 2.83 | 1.39 | 1.47 |
| 11 | 2.58 | 2.87 | 2.53 | 2.79 |
| 12 | 2.66 | 2.81 | 2.65 | 2.77 |

As is shown in Table 5, when the samples were stored for 5 months, a great reduction in the maximum coupling density was observed in Samples 2, 6, and 10, while such a defect was completely removed in Samples 4, 8, and 12, each containing the hydroquinone compound according to the present invention. Also, when these samples thus processed were subjected to the forced deterioration test as described in Example 1, it was confirmed that Samples 8 and 12 which are the color photographic materials of this invention kept magenta dye images having excellent spectral absorption characteristics.

EXAMPLE 3

A paper support having polyethylene layers coated on both surfaces was coated with a coating composition prepared by incorporating a yellow coupler, α-pivaloyl-α-(5,5-dimethyl-3-oxazolidinyl)-2-chloro-5-[α-(2,4-di-tert-amylphenoxy)butyramido] acetanilide in a silver chlorobromide emulsion (15 mol percent silver chloride) prepared by a halogen conversion method to form a blue-sensitive emulsion layer having a dry thickness of 3 microns ($0.58 \times 10^{-3}$ mol coupler/m$^2$ and $1.76 \times 10^{-3}$ mol silver/m$^2$). Then, a gelatin intermediate layer containing tert-octyl hydroquinone (0.05 g/m$^2$) was coated on the emulsion layer in a dry thickness of 1.5 microns.

A solution prepared by heating to 60°C a mixture of 3.6 g of the magenta dye forming coupler, Cp-3 of this invention, 0.35 g of the phenolic compound, Ph-6, 0.3 g of the hydroquinone, Hq-6, 3.0 ml of tricresyl phosphate, and 12 ml of ethyl acetate was added to 40 ml of an aqueous solution containing 4 g of gelatin and 0.1 g of sodium dodecylbenzenesulfonate at 60°C and then the mixture was stirred using a homogenizer to provide a coupler dispersion.

100 g of a silver chlorobromide emulsion (containing 50 mol percent silver chloride) (containing $4.7 \times 10^{-2}$ mol of silver chlorobromide and 9 g of gelatin) prepared by a halogen conversion method was spectrally sensitized so that it has a sensitization maximum to about 545 μ and was added to the coupler dispersion prepared above. After adding 5 ml of a 3% acetone solution of triethylene phosphamide as a hardening agent to the above mixture and adjusting the pH of the mixture to 6.5, the resultant mixture was coated on the above-prepared gelatin intermediate layer in a dry thickness of 3.1 microns to provide a green-sensitive silver halide emulsion layer. Then, a gelatin intermediate layer containing 2-(2-hydroxy-3-tert-butyl-5-methylphenyl)-5-chlorobenzotriazole (0.4 g/m$^2$), 2-(2-hydroxy-3-tert-butylphenyl)benzotriazole (0.4 g/m$^2$), and 2,5-di-tert-octylhydroquinone (0.1 g/m$^2$) was formed on the silver halide emulsion layer in a dry thickness of 2.3 microns.

A silver chlorobromide emulsion (containing 40 mol percent silver bromide) prepared by a halogen conversion method was spectrally sensitized so that the emulsion had the sensitization maximum at about 685 μ and then after adding to the emulsion a cyan dye forming coupler, 2-[α-(2,4-di-tert-amylphenoxy)butyramido]-4,6-dichloro-5-methylphenyl, the coating composition thus prepared was coated on the intermediate layer in a dry thickness of 2.5 microns as a red-sensitive emulsion layer ($0.45 \times 10^{-3}$ mol coupler/m$^2$ and $1.35 \times 10^{-3}$ mol silver/m$^2$). Then, a gelatin solution was coated thereon in a dry thickness of 1 micron as a surface protective layer. Thus, a multilayer multicolor photographic material (Sample 13) was prepared.

The same procedure as in preparing Sample 13 was repeated without adding Ph-6 and Hq-6 to the green-sensitive emulsion layer to provide Sample 14, without adding Ph-6 to the green-sensitive emulsion layer to provide Sample 15, and without adding Hq-6 to the green-sensitive emulsion layer to provide Sample 16.

Each of the samples thus prepared was stored for 5 days at 25°C and 60% RH, exposed using an optical wedge through each of red, green, and blue filters, and developed as described in Example 1. Then, after the samples thus processed were exposed to a fluorescent lamp of about 10,000 lux for two weeks, the light fastness of the color images and the occurrence of stains at the low density portions of the color images were observed. The evaluation of the light fastness of the magenta dye images was conducted by measuring the densities of the portions having initial densities (green light) of 0.5, 1.0, and 2.0 after the fading test and then calculating the density reduction ratio(%) with respect to the initial densities. Also, the staining condition was determined by the density value at the highlight portion measured by blue light after the fading test. These results are shown in Table 6.

TABLE 6

| Sample | Coupler | Phenolic Compound | Hydroquinone | Image Fastness Initial Density 0.5 | 1.0 | 2.0 | Stain |
|---|---|---|---|---|---|---|---|
| 13 | Cp-3 | Ph-6 | Hq-6 | 9 | 7 | 5 | 0.11 |
| 14 | Cp-3 | — | — | 45 | 28 | 15 | 0.23 |
| 15 | Cp-3 | — | Hq-6 | 35 | 22 | 12 | 0.12 |
| 16 | Cp-3 | Ph-6 | — | 10 | 7 | 5 | 0.25 |

In addition, substantially no differences existed in the light fastness of the yellow dye images and the cyan dye images among Samples 13 to 16 - density reduction ratio of the yellow dye images was 5%, 4%, and 3%, respectively (each of the initial densities were 0.5, 1.0, and 2.0), and the density reduction ratio of the cyan dye images was 10%, 8%, and 5%, respectively (each of the initial densities was 0.5, 1.0, and 2.0).

As is clear from the results shown in Table 6, in Sample 13 which is a color photographic material of this invention, the magenta dye image had excellent light fastness, the yellow dye image and the cyan dye image had good balanced light fastness, and the formation of stains was quite less.

After storing Samples 13 to 16 for 5 months at 25°C and 60% RH, the samples were exposed and developed as in the above described procedure, the maximum density of the magenta dye images thus obtained was measured, and the results obtained are shown in Table 7 as the ratio to the maximum density of the magenta dye images of samples which were stored for 5 days.

TABLE 7

| Sample | Change (%) in Maximum Density |
|---|---|
| 13 | 99 |
| 14 | 98 |
| 15 | 101 |
| 16 | 58 |

From the above results in Table 7, it can be understood that the reduction in the maximum density based on the presence of the phenolic compound during storage (Sample 16) could be substantially completely prevented by using together the hydroquinone of this invention (Sample 13).

EXAMPLE 4

A coupler dispersion was prepared in the same way as in the case of preparing Sample 8 in Example 1 using the magenta dye forming coupler ($1.4 \times 10^{-2}$ mol), the phenolic compound, and the hydroquinone shown in Table 8, mixed with a silver halide emulsion, and the mixture was coated on a cellulose triacetate film. Thus, Samples 17 to 30 were prepared.

The samples were stored for 5 days at 25°C and 60% RH, exposed through an optical wedge, and developed as described in Example 2 except that the color development was conducted for 14 minutes and the composition of the color developer as shown below was employed in this case.

| Color Developer: | | |
|---|---|---|
| 4-(N,N-Diethylamino)-2-methylaniline hydrochloride | 2.5 | g |
| Sodium Sulfite (anhydrous) | 10 | g |
| Sodium Carbonate (monohydrate) | 47 | g |
| Potassium Bromide | 2 | g |
| Water to make | 1 | l |

The main absorption wave lengths of the magenta dye images thus formed are shown in Table 8.

Also, the samples as described above were stored for 6 months at 25°C and 60% RH and exposed and processed as described above. The maximum density of the magenta dye image thus obtained was measured and is shown in Table 8 as the ratio (%) to the maximum density of the magenta dye image formed in the sample stored for 5 days.

TABLE 8

| Sample | Coupler | Phenolic Compound | Hydroquinone Compound | Main Absorption Wave Length (mμ) | Change in Maximum Density (%) |
|---|---|---|---|---|---|
| 17 | Cp-5 | Ph-2,2g | Hq-6,1g | 545 | 100 |
| 18 | Cp-6 | Ph-7,2g | Hq-4,1g | 545 | 96 |
| 19 | Cp-7 | Ph-9,2g | Hq-11,1g | 545 | 98 |
| 20 | Cp-8 | Ph-6,1g | Hq-6,1g | 544 | 99 |
| 21 | Cp-9 | Ph-4,2g | Hq-15,1g | 544 | 98 |
| 22 | Cp-11 | Ph-13,1g | Hq-8,1g | 544 | 98 |
| 23 | Cp-12 | Ph-8,2g | Hq-7,1g | 540 | 95 |
| 24 | Cp-13 | Ph-3,3g | Hq-5,1g | 537 | 97 |
| 25 | Cp-15 | Ph-6,1g | Hq-6,1g | 543 | 98 |
| 26 | Cp-16 | Ph-7,2g | Hq-2,1g | 542 | 96 |
| 27 | CP-18 | PH-6,1g | Hq-6,1g | 547 | 101 |
| 28 | Cp-20 | Ph-4,2g | Hq-3,1g | 545 | 99 |
| 29 | Cp-21 | Ph-6,2g | Hq-1,2g | 545 | 98 |
| 30 | Cp-22 | Ph-6,1g | Hq-6,1g | 542 | 98 |

As is clear from the results in Table 8, when the color photographic materials of this invention were stored for a long period of time, substantially no reduction in coupling density resulted and good magenta dye images were obtained.

EXAMPLE 5

Samples 8 and 12 as described in Example 1, Samples 18, 23, and 25 as described in Example 4, and Sample 13 as described in Example 3 were stored for 5 days at 25°C and 60% RH, exposed through an optical wedge (using a green filter for Sample 13 only), and processed as described in Example 1 except that the processing temperature was increased to 38°C, the color development was conducted for 3 minutes, and a color developer having the composition as shown below was employed.

| | | |
|---|---|---|
| Color Developer: | | |
| Sodium Hydroxide | 2 | g |
| Sodium Sulfite | 2 | g |
| Potassium Bromide | 0.4 | g |
| Sodium Chloride | 1 | g |
| Borax | 4 | g |
| Hydroxylamine Sulfate | 2 | g |
| Ethylenediamine Tetraacetic Acid | 2 | g |
| 4-(N-Ethyl-N-β-hydroxyethylamino)-2-methylaniline.Sesquisulfate (monohydrate) | 4 | g |
| Water to make | 1 | l |

The main absorption wave length of the magenta dye image thus formed is shown in Table 9.

Also, each sample was stored for 6 months at 25°C and 60% RH, exposed and processed as described above, and the maximum density of the magenta dye image thus formed was measured. The maximum density is also shown in Table 9 as the ratio (%) to the maximum density of the magenta dye image of the sample stored for 5 days.

TABLE 9

| Sample | Main Absorption Wave Length (mμ) | Change in Maximum Density (%) |
|---|---|---|
| 8 | 545 | 98 |
| 12 | 548 | 101 |
| 18 | 545 | 96 |
| 23 | 541 | 96 |
| 25 | 548 | 95 |
| 13 | 545 | 100 |

As is clear from the results shown in Table 9, it can be understood that when the color photographic materials of this invention were stored for a long period of time, the coupling density was substantially not reduced and good magenta dye images were obtained.

While the invention has been described in detail and with reference to specific embodiments thereof, it will be apparent to one skilled in the art that various changes and modifications can be made therein without departing from the spirit and scope thereof.

What is claimed is:

1. A color photographic material comprising at least one silver halide emulsion layer containing a magenta dye forming coupler comprising a 3-anilino-5-pyrazolone type coupler having a hydrophobic ballast group on the aromatic nucleus of the anilino group contained in combination with a phenolic compound containing an ether bond at the 4-position and having the ability to improve the light fastness of the magenta dye image formed by the coupling reaction of said magenta dye forming coupler with the oxidation produce of an aromatic primary amine color developing agent and a nucleus-substituted hydroquinone, wherein said magenta dye forming coupler is represented by the general formula (I)

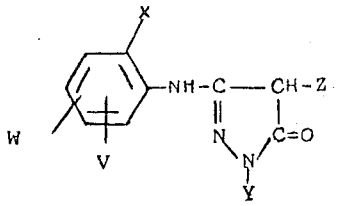

(I)

wherein X represents an alkyl group, an aryl group, an alkoxy group, an aryloxy group, an N-substituted amino group, an amido group, a halogen atom, a hydroxyl group, a cyano group, or a nitro group; Y represents an aryl group or a heterocyclic group; Z represents a hydrogen atom or a coupling releasable group which is releasable from the active carbon at the coupling position of said coupler when the coupler couples with the oxidation product of an aromatic primary amine color developing agent; W represents a hydrophobic ballast group; and V represents a hydrogen atom or a group as defined for X or W; and wherein said phenolic compound is represented by the general formulae (III-*a*), (III-*b*) or (III-*c*):

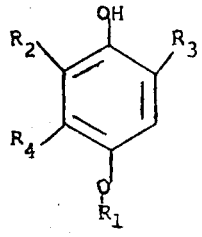

(III-a)

wherein $R_1$ represents an alkyl group, an aryl group, an aralkyl group, or a terpenyl group; and $R_2$, $R_3$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, or a halogen atom;

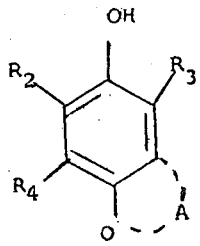

(III-b)

wherein $R_2$, $R_3$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, or a halogen atom; and A represents the non-metallic atoms necessary for forming a 5-membered ring or a 6-membered ring together with the

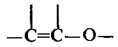

moiety; or

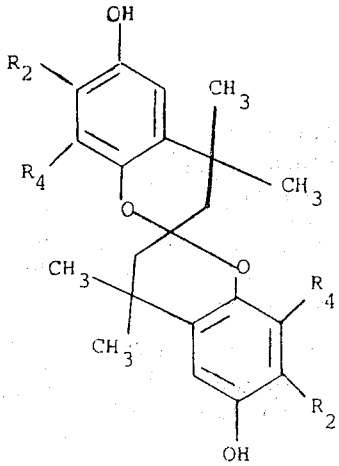

(III-c wherein $R_2$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, or a halogen atom.

2. A color photographic material comprising a support having thereon at least one silver halide emulsion layer containing a. A 3-anilino-5-pyrazolone type magenta dye forming coupler having a hydrophoblic ballast group on the aromatic nucleus of the anilino group, b. a phenolic compound having an ether bond at the 4-position and having the ability to improve the light fastness of the magenta dye image formed by the coupling of said magenta dye forming coupler with the oxidation product of an aromatic primary amine color developing agent, and c. a nucleus-substituted hydroquinone, wherein said magenta dye forming coupler is represented by the general formula (I)

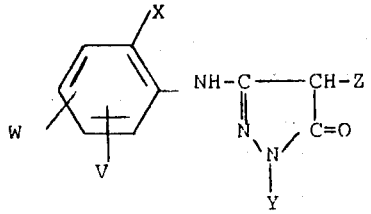

(I)

wherein X represents an alkyl group, an aryl group, an alkoxy group, an aryloxy group, an N-substituted amino group, an amido group a halogen atom, a hydroxyl group, a cyano group, or a nitro group; Y represents an aryl group or a heterocyclic group; Z represents a hydrogen atom or a coupling releasable group which is releasable from the active carbon at the coupling position of said coupler when the coupler couples with the oxidation product of an aromatic primary amino color developing agent; W represents a hydrophobic ballast group; and V represents a hydrogen atom or a group as defined for X or W; wherein said phenolic compound is represented by the general formulae (III-*a*), (III-*b*) or (III-*c*):

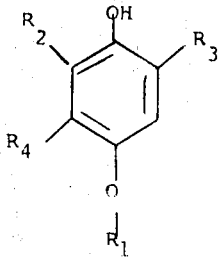

(III-a)

wherein $R_1$ represents an alkyl group, an aryl group, an aralkyl group, or a terpenyl group; and $R_2$, $R_3$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, or a halogen atom;

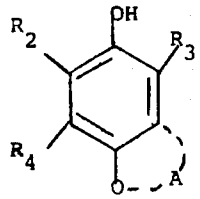

(III-b)

wherein $R_2$, $R_3$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, or a halogen atom; and A represents the non-metallic atoms necessary for forming a 5-membered ring or a 6-membered ring together with the

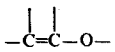

moiety; or

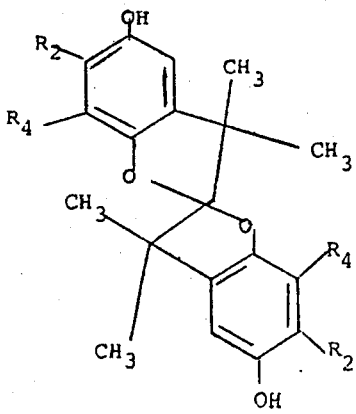

(III-c)

wherein $R_2$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, or a halogen atom and wherein said nucleus-substituted hydroquinone is represented by the general formula (IV)

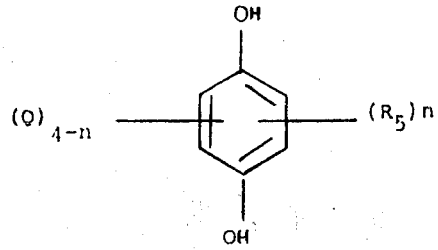

(IV)

wherein $R_5$ represents an alkyl group, an aryl group, and alkoxy group, an aryloxy group, a carbamoyl group, a sulfamoyl group, an acyl group, an alkoxycarbonyl group, or an aryloxycarbonyl group; Q represents a hydrogen atom or a halogen atom; and *n* is an integer of 1 to 4.

3. The color photographic material as set forth in claim 1, in which said magenta dye forming coupler is represented by the general formula (II)

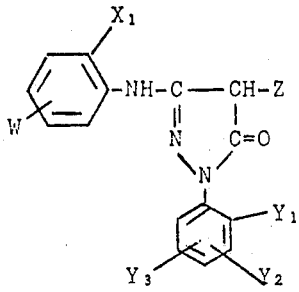

(II)

wherein W represents a hydrophobic ballast group; Z represents a hydrogen atom or a coupling releasable group; $X_1$ represents an alkyl group having 1 to 4 carbon atoms, an alkoxy group having 1 to 4 carbon atoms, a halogen atom, a hydroxyl group, a cyano group, or a nitro group; $Y_1$ represents a halogen atom, an alkoxy group, an alkyl group, a carboxyl group, an alkoxycarbonyl group, a nitro group, an aryloxy group, a cyano group, or an acylamino group; and $Y_2$ and $Y_3$, which may be the same or different, each represents a hydrogen atom or a group as defined for $Y_1$.

4. The color photographic material as set forth in claim 3, wherein $X_1$ is a halogen atom.

5. The color photographic material as set forth in claim 2, in which $R_5$ represents a straight chain or branch chain alkyl group or an aralkyl group; Q is a hydrogen atom, and the total number of carbon atoms in the $R_5$ group or $R_5$ groups is 8 or more.

6. The color photographic material as set forth in claim 1 wherein X is an alkyl group.

7. The color photographic material as set forth in claim 1 wherein X is a halogen atom.

8. The color photographic material as set forth in claim 5 wherein X is chlorine.

9. The color photographic material as set forth in claim 1 wherein X is alkoxy.

10. The color photographic material as set forth in claim 2 wherein X is an alkyl group.

11. The color photographic material as set forth in claim 2 wherein X is a halogen atom.

12. The color photographic material as set forth in claim 11 wherein X is chlorine.

13. The color photographic material as set forth in claim 2 wherein X is alkoxy.

14. The color photographic material as set forth in claim 3 wherein $X_1$ is an alkyl group.

15. The color photographic material as set forth in claim 4 wherein $X_1$ is chlorine.

16. The color photographic material as set forth in claim 3 wherein $X_1$ is alkoxy.

17. The color photographic material as set forth in claim 1, wherein Z is hydrogen.

18. The color photographic material as set forth in claim 1, wherein Z is selected from the group consisting of a thiocyano group, an acyloxy group, an aryloxy group, an aralkyloxycarbonyloxy group, an alkyloxycarbonyloxy group, a halogen atom, an arylazo group, a 2-aryltriazolyl group, and alkylthio group, an arylthio group, a heterothio group, a cycloalkylthio group, a cycloalkoxy group and an N-heterocyclic group.

19. The color photographic material as set forth in claim 1, wherein Z is selected from the group consisting of an acetoxy group, a dodecanoyloxy group, an octadecanoyloxy group, a 3-pentadecylphenoxyacetoxy group, a benzoyloxy group, a β-naphthoyloxy group, a 3-[γ-(2,4-di-t-amylphenoxy)-butylamido] benzoyloxy group, a phenoxy group, a p-chlorophenoxy group, a p-nitrophenoxy group, a naphthoxy group, a benzyloxycarbonyloxy group, an ethyloxycarbonyloxy group, a chlorine atom, a bromine atom, a fluorine atom, a phenylazo group, a hydroxyphenylazo group, a chlorophenylazo group, a methylphenylazo group, a methoxyphenylazo group, a naphthylazo group, a 2-benzotriazolyl group, a 2-naphthoazolyl group, an alkylthio group having 4 to 10 carbon atoms, a phenylthio group, a naphthylthio group, a 2-benthiazolylthio group, a 1-phenyl-5-tetrazolylthio group, a 2-benzoxazolylthio group, a 2-benzimidazolylthio group, a 5-phenyl-1,3,4-oxadiazolyl-2-thio group, a cyclohexylthio group, a cyclohexyloxy group, a phthalimido group, a 1,2,3,4-tetra-hydroisoquinolyl group, a piperidinyl group, a imidazolyl group, and a 5,5′-dimethyl-3-hydantoinyl group.

20. The color photographic material as set forth in claim 2, wherein Z is hydrogen.

21. The color photographic material as set forth in claim 2, wherein Z is selected from the group consisting of a thiocyano group, an acyloxy group, an aryloxy group, an aralkyloxycarbonyloxy group, an alkyloxycarbonyloxy group, a halogen atom, an arylazo group, a 2-aryltriazolyl group, an alkylthio group, an arylthio group, a heterothio group, a cycloalkylthio group, a cycloalkoxy group and an N-heterocyclic group.

22. The color photographic material as set forth in claim 2, wherein Z is selected from the group consisting of an acetoxy group, a dodecanoyloxy group, an octadecanoyloxy group, a 3-pentadecylphenoxyacetoxy group, a benzoyloxy group, a β-naphthoyloxy group, a 3-[γ-(2,4-di-t-amylphenoxy)-butylamido] benzoyloxy group, a phenoxy group, a p-chlorophenoxy group, a p-nitrophenoxy group, a naphthoxy group, a benzyloxycarbonyloxy group, an ethyloxycarbonyloxy group, a chlorine atom, a bromine atom, a fluorine atom, a phenylazo group, a hydroxyphenylazo group, a chlorophenylazo group, a methylphenylazo group, a methoxyphenylazo group, a naphthylazo group, a 2-benzotriazolyl group, a 2-naphthoazolyl group, an alkylthio group having 4 to 10 carbon atoms, a phenylthio group, a naphthylthio group, a 2-benzthiazolylthio group, a 1-phenyl-5-tetrazolylthio group, a 2-benzoxazolylthio group, a 2-benzimidazolylthio group, a 5-phenyl-1,3,4-oxadiazolyl-2-thio group, a cyclohexylthio group, a cyclohexyloxy group, a phthalimido group, a 1,2,3,4-tetra-hydroisoquinolyl group, a piperidinyl group, an imidazoly group and a 5,5′-dimethyl-3-hydrantoinyl group.

* * * * *